US006650855B1

(12) United States Patent
Tajima

(10) Patent No.: US 6,650,855 B1
(45) Date of Patent: Nov. 18, 2003

(54) COLOR IMAGE FORMING APPARATUS WITH MULTIPLE DEVELOPMENT UNITS SUPPORTED BY A ROTATABLE CARRIAGE

(75) Inventor: Noriyuki Tajima, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 85 days.

(21) Appl. No.: 09/959,139

(22) PCT Filed: Jul. 12, 2000

(86) PCT No.: PCT/JP00/04685

§ 371 (c)(1),
(2), (4) Date: Oct. 17, 2001

(87) PCT Pub. No.: WO01/06324

PCT Pub. Date: Jan. 25, 2001

(30) Foreign Application Priority Data

Jul. 16, 1999 (JP) ..... 11/203830

(51) Int. Cl.[7] ..... G03G 15/01
(52) U.S. Cl. ..... 399/227
(58) Field of Search ..... 399/226, 227, 399/228, 223

(56) References Cited

U.S. PATENT DOCUMENTS

| | | | |
|---|---|---|---|
| 5,809,380 A | 9/1998 | Katakabe et al. | 399/227 |
| 5,956,552 A | 9/1999 | Katakabe et al. | 399/298 |

FOREIGN PATENT DOCUMENTS

| | | |
|---|---|---|
| EP | 840 174 | 5/1998 |
| JP | 6-317966 | 11/1994 |
| JP | 8-6400 | 1/1996 |
| JP | 8-82975 | 3/1996 |
| JP | 8-185008 | 7/1996 |
| JP | 9-269655 | 10/1997 |
| JP | 9-288419 | 11/1997 |
| JP | 10-142889 | 5/1998 |
| JP | 11-24361 | 1/1999 |
| JP | 11-295953 | 10/1999 |
| WO | 98/13732 | 4/1998 |

OTHER PUBLICATIONS

PCT/IB/338.

English translation of the International Preliminary Examination Report.

*Primary Examiner*—Fred L Braun
(74) *Attorney, Agent, or Firm*—Merchant & Gould, P.C.

(57) ABSTRACT

On each of inner surfaces of left and right side plates of an apparatus main body, guide rails for restricting a moving track of development units during the rotation of a carriage are provided. The guide rails are formed to have a downwardly-bent arc shape whose center corresponds to the rotation center of the carriage, and both ends of the development units are supported by these guide rails. The development units can be prevented from dropping out of the carriage without any lock mechanism, thus achieving a color image forming apparatus in which the development units can be attached/removed easily. The position of the developing units may be restricted using a unit positioning pin. The unit positioning pins may be moved in a direction parallel to a rotation axis of the carriage, thereby restricting the position of the developing unit in a particular direction.

22 Claims, 12 Drawing Sheets

(A)

(B)

COLOR IMAGE FORMING APPARATUS WITH MULTIPLE DEVELOPMENT UNITS SUPPORTED BY A ROTATABLE CARRIAGE

TECHNICAL FIELD

The present invention relates to a color image forming apparatus that can be applied to a color printer, a color copying machine or a color facsimile, and it relates, in particular, to a color image forming apparatus that forms a color image by overlapping multicolor toner images by electrophotography.

BACKGROUND ART

In such a color image forming apparatus, development units of four colors (yellow, magenta, cyan and black) usually are used. These development units are contained in a carriage supported rotatably within a perpendicular plane in a main body of the apparatus, so that a photosensitive body of the development unit for each color is moved sequentially between an image forming position and a waiting position, whereby the development units can be switched.

In this type of color image forming apparatus in which a plurality of the development units are contained in the carriage and rotated within the perpendicular plane as described above, it is necessary to provide a mechanism for preventing each of the development units from dropping out of the carriage. In the following, the configuration around a carriage of a conventional color image forming apparatus having such mechanism will be described with reference to FIG. 12.

As shown in FIG. 12, the interior of a carriage 1041 is provided with four carriage reinforcing plates 109 that are arranged radially from a rotation center of the carriage 101 and spaced away from each other by 90°. These carriage reinforcing plates 109 also serve as partition plates for dividing an inner space of the carriage 101 into four spaces. A development unit 102 is contained in each of these four spaces.

Each of these four spaces in the carriage 101 is provided with a carriage guide groove 105 and a guide pin groove 106 for guiding the development unit 102. The end of the carriage guide groove 105 is formed to be slightly larger than the other portion. Also, near the end of the guide pin groove 106, a unit lock member 107 is provided such that its tip is located inside the guide pin groove 106, and the unit lock member 107 constantly is forced by a unit lock spring 108 toward the guide pin groove 106. On the other hand, each of the development units 102 is provided with a development unit rotating shaft 103 to be guided along the carriage guide groove 105 and a development unit guide pin 104 to be guided along the guide pin groove 106. The development unit rotating shaft 103 has an oval-shaped cross-section. After being inserted in the carriage 101 from above, each of the development units 102 is rotated toward an arrow direction, so that the development unit guide pin 104 advances over the unit lock member 107 and then is locked. At this time, the development unit rotating shaft 103 comes to engage the end of the carriage guide groove 105. The above-described double lock state makes it possible to prevent each of the development units 102 from dropping out of the carriage 101.

However, in the conventional color image forming apparatus described above, because the lock mechanism is provided, two actions are needed for attaching the development unit to the apparatus main body or removing the development unit from the apparatus main body, causing a problem in that the attaching/removing of the development units becomes complicated.

DISCLOSURE OF INVENTION

The present invention was made in order to solve the conventional problem mentioned above, and it is an object of the present invention to provide a color image forming apparatus that can prevent a development unit from dropping out of a carriage, without any lock mechanism.

In order to achieve the above-mentioned object, a first configuration of a color image forming apparatus according to the present invention includes a plurality of development units, each development unit having a toner for a different color and a developing member, a carriage for supporting the plurality of development units so as to be attachable/removable with respect to an apparatus main body, a carriage driving system for rotating the carriage so as to move the plurality of development units sequentially and switch them between an image forming position and a waiting position, a unit positioning system for positioning the development unit at a normal position with respect to the apparatus main body in the image forming position, guide rails for restricting a moving track of the development unit during a rotation of the carriage, and a transfer system for transferring a toner image formed by the plurality of development units onto a printing medium. With this first configuration of the color image forming apparatus, since the development unit can be rotated in such a manner as to be held between the carriage and the guide rails, the moving track of the development unit is stabilized. Also, since a lock mechanism or the like for preventing the development unit from dropping out of the carriage becomes unnecessary, the development unit can be attached or removed in a single action when it is located in an upper side of the carriage.

In the first configuration of the color image forming apparatus according to the present invention described above, it is preferable that the guide rails are fixed to left and right side plates of the apparatus main body, and both ends of the development unit are supported by the guide rails. With this preferable example, the guide rails can be formed using relatively small members.

In the first configuration of the color image forming apparatus according to the present invention described above, it is preferable that the guide rails are formed to have an arc shape whose center corresponds to a rotation center of the carriage, and a bisectional point of the arc shape (a point bisecting the arc) of each of the guide rails is located lower than the rotation center of the carriage. With this preferable example, the development unit reliably can be prevented from dropping out.

In the first configuration of the color image forming apparatus according to the present invention described above, it is preferable that at least one of the plurality of development units can be attached to/removed from the apparatus main body when located outside a fan-shape formed by the guide rails and a rotation center of the carriage. With this preferable example, the development unit can be removed only by lifting it up and attached only by dropping it in.

In the first configuration of the color image forming apparatus according to the present invention described above, it is preferable that the development unit does not contact the guide rails when the development unit is positioned in the image forming position by the unit positioning system. With this preferable example, since the development unit does not contact the guide rails in the image forming position, the development unit can be positioned accurately. After the positioning, it also is possible to prevent an external force inhibiting an excellent image formation from being applied to the development unit.

In the first configuration of the color image forming apparatus according to the present invention described above, it is preferable that each of the plurality of development units integrally includes a photosensitive body having a surface on which a static latent image is formed, and development unit guide portions that slide in contact with the guide rails during the rotation of the carriage are provided on left and right ends of the photosensitive body. With this preferable example, while avoiding the contact of the exposed photosensitive body with the guide rails and other components on the main body side, it is possible to restrict the moving track of the development units reliably during the rotation of the carriage. In this case, it is preferable that the development unit guide portions are provided on a line connecting a rotation center of the carriage and a center of the photosensitive body. With this preferable example, it is possible to minimize the contact length along which the photosensitive body slides over the intermediate transfer belt during the rotation of the carriage (an unprintable region). Furthermore, in this case, it is preferable that a concave portion is provided in a part of the guide rails so that the development unit guide portions do not contact the guide rails when the development unit is positioned in the image forming position by the unit positioning system. With this preferable example, since the development unit can be prevented from contacting the guide rails in the image forming position, the development unit can be positioned accurately. Also, it is possible to prevent an external force inhibiting an excellent image formation from being applied to the development unit.

Furthermore, a second configuration of a color image forming apparatus according to the present invention includes a plurality of development units, each development unit having a toner for a different color and a developing member, a carriage for supporting the plurality of development units so as to be attachable/removable with respect to an apparatus main body, a carriage driving system for rotating the carriage so as to move the plurality of development units sequentially and switch them between an image forming position and a waiting position, a unit positioning system for positioning the development unit at a normal position with respect to the apparatus main body in the image forming position, a carriage positioning system for positioning the carriage at a normal position with respect to the apparatus main body, and a transfer system for transferring a toner image formed by the plurality of development units onto a printing medium. With this second configuration of the color image forming apparatus, even when a rotational force is applied to the carriage during a printing operation, the carriage can be held in an accurate position. In addition, since the positioning mechanism is provided independently of the carriage driving mechanism, a positional accuracy of the stopping position required for the carriage driving mechanism is eased.

In the second configuration of the color image forming apparatus according to the present invention described above, it is preferable that, when the development unit and the carriage are positioned in the image forming position, the development unit other than the positioned development unit can be attached to/removed from the apparatus main body. With this preferable example, the attachment/removal of the development unit and the image formation are possible in one carriage stopping position, eliminating the need for providing another carriage stopping position for the attachment/removal of the development unit, allowing a simple control. In addition, the attachment/removal of the development unit is not prevented by an accompanying rotation of the carriage. In this case, it is preferable that, in a waiting state of the apparatus, the carriage is positioned and fixed to the normal position with respect to the apparatus main body. With this preferable example, simply by opening an upper cover of the apparatus in the waiting state, the development unit can be replaced. In addition, there is no concern of rotating the carriage by mistake when opening the upper cover of the apparatus in the waiting state.

In the second configuration of the color image forming apparatus according to the present invention described above, it is preferable that the unit positioning system and the carriage positioning system both include a pin reciprocating in a direction parallel to a rotation axis of the carriage. With this preferable example, two members, namely, the development unit and the carriage can be positioned by a single driving source and transmitting members, achieving a simple configuration.

Moreover, a third configuration of a color image forming apparatus according to the present invention includes a plurality of development units, each development unit having a toner for a different color and a developing member, a carriage for supporting the plurality of development units so as to be attachable/removable with respect to an apparatus main body, a carriage driving system for rotating the carriage so as to move the plurality of development units sequentially and switch them between an image forming position and a waiting position, a transfer system for transferring a toner image formed by the plurality of development units onto a printing medium, a carriage position detecting portion formed integrally with the carriage in an outermost peripheral portion of one of the left and right ends of the carriage, a position detection sensor for detecting the carriage position detecting portion, and a unit detecting portion formed integrally with the development unit so as to be located at substantially the same distance from a rotation center of the carriage as the carriage position detecting portion. With this third configuration of the color image forming apparatus, since the position detecting portions are formed integrally with the carriage and the development unit, it is possible to detect the position of the carriage and the presence of the development unit using a single sensor without an additional component.

In the third configuration of the color image forming apparatus according to the present invention described above, it is preferable that the number of the carriage position detecting portions is the same as that of the development units supported by the carriage, and one of the carriage position detecting portions has a different shape from the other carriage position detecting portions. With this preferable example, it is possible to detect an origin of one rotation of the carriage by the single position detection sensor, allowing a color detection.

Also, in the third configuration of the color image forming apparatus according to the present invention described above, it is preferable that the unit detecting portion has a different shape from the carriage position detecting portion. With this preferable example, it is possible to discriminate between the detection of the carriage position and that of the presence of the development unit.

Also, in the third configuration of the color image forming apparatus according to the present invention described above, it is preferable that a plurality of the unit detecting portions can be provided for each one of the development units. With this preferable example, it is possible to detect information of the development unit, for example, a difference of a contained toner and photosensitive body sensitivity and that of an intended use.

Also, a fourth configuration of a color image forming apparatus according to the present invention includes a plurality of development units, each development unit having a toner for a different color and a developing member, a carriage for supporting the plurality of development units so as to be attachable/removable with respect to an apparatus main body, a carriage driving system for rotating the carriage so as to move the plurality of development units sequentially and switch them between an image forming position and a waiting position, and a transfer system for transferring a toner image formed by the plurality of development units onto a printing medium. The carriage includes left and right carriage side plates that can position the development unit substantially and a hollow pipe member that joins the left and right carriage side plates, and the pipe member includes two-divided sheet-like pipe element members. With this fourth configuration of the color image forming apparatus, the hollow pipe member is two-divided, and an inexpensive pipe member can be achieved.

In the fourth configuration of the color image forming apparatus according to the present invention described above, it is preferable that one of the two-divided pipe element members has at least one convex portion provided perpendicularly to a rotation axis of the carriage, and the other has a concave portion that fits the convex portion. With this preferable example, when the pipe member is twisted, these two pipe element members can be prevented from sliding in a direction parallel to the rotation axis of the carriage, thereby improving the torsional stiffness of the pipe member considerably.

Also, in the fourth configuration of the color image forming apparatus according to the present invention described above, it is preferable that the pipe member has a polygonal cross-section perpendicular to a rotation axis of the carriage. With this preferable example, it is possible to achieve a further inexpensive hollow pipe member using the pipe element members, which can be manufactured in an inexpensive manner by a regular press working.

Furthermore, a fifth configuration of a color image forming apparatus according to the present invention includes a plurality of development units, each development unit having a toner for a different color and a developing member, a photosensitive body, a carriage for supporting the plurality of development units so as to be attachable/removable with respect to an apparatus main body, a carriage driving system for rotating the carriage so as to move the plurality of development units sequentially and switch them between an image forming position and a waiting position, an exposing system for exposing the photosensitive body, and a transfer system for transferring a toner image formed on the photosensitive body onto a printing medium. The exposing system is a laser beam scanner whose light source is a semiconductor laser, and a part of or all of an image forming lens and a reflecting mirror that serve as element members of the laser beam scanner are arranged inside a rotational moving track of the plurality of development units. With this fifth configuration of the color image forming apparatus, a further compact apparatus can be achieved.

In the fifth configuration of the color image forming apparatus according to the present invention described above, it is preferable to further include carriage rotating shaft members that are fixed to left and right side plates of the apparatus main body and support a rotation axis of the carriage, in which the reflecting mirror is fixed to the carriage rotating shaft members at a position substantially matching the rotation axis of the carriage. With this preferable example, it is possible to minimize an error of the attachment position of the reflecting mirror. In this case, it is preferable that the carriage rotating shaft members are attached rotatably with respect to the left and right side plates of the apparatus main body. With this preferable example, the angle of the reflecting mirror easily can be adjusted simply by rotating the carriage rotating shaft members. Consequently, it is not necessary to add another component for the angle adjustment, contributing to a cost reduction.

Moreover, a sixth configuration of a color image forming apparatus according to the present invention includes a plurality of development units, each development unit having a toner for a different color and a developing member, a carriage for supporting the plurality of development units so as to be attachable/removable with respect to an apparatus main body, a carriage driving system for rotating the carriage so as to move the plurality of development units sequentially and switch them between an image forming position and a waiting position, and a transfer system for transferring a toner image formed by the plurality of development units onto a printing medium. The development unit is supported inside the carriage so as to be capable of reciprocating in a direction parallel to a rotation axis of the carriage. With this sixth configuration of the color image forming apparatus, since the development unit is capable of reciprocating in the carriage, a part of the unit positioning system, which positions the development unit with respect to the apparatus main body in the image forming position, can be supported rigidly in the apparatus main body. This makes it possible to improve the positioning accuracy and constitute the apparatus at low cost.

In the sixth configuration of the color image forming apparatus according to the present invention described above, it is preferable to further include a unit feeder terminal that is provided on an end face of the development unit perpendicular to the rotation axis of the carriage, for supplying a voltage or an electric current necessary for an image formation to the development unit, and a main body feeder terminal that is provided in the apparatus main body, for supplying electricity by contacting the unit feeder terminal directly when the development unit is in the image forming position. With this preferable example, since the development unit is capable of reciprocating in a direction of the rotation axis of the carriage, the unit feeder terminal and the main body feeder terminal do not contact each other or contact with a slight contact pressure during the rotation of the carriage. Therefore, it is possible to suppress a change in characteristics of the terminal surface caused by abrasion and noise generation caused by friction. In addition, since the unit feeder terminal is brought into contact with the main body feeder terminal while being connected with the positioning system of the development unit, it is possible to achieve the connection of the both terminals without any driving source exclusively for this purpose.

In the above-described preferable example, it is further preferable to include a unit positioning system for positioning the development unit at a normal position with respect to the apparatus main body in the image forming position, the unit positioning system including a pair of unit positioning pins that are capable of moving in the direction parallel to the rotation axis of the carriage and restrict a position of the development unit in this direction, in which the position of the development unit is restricted substantially using the unit positioning pin on a side of the main body feeder terminal, and then the position of the development unit is restricted using the unit positioning pin on the other side. With this preferable example, when positioning the development unit, it is possible to minimize the amount the development unit moves in the direction of the rotation axis of the carriage, thereby preventing deformation or breakage of the main body feeder terminal and abrasion of the unit feeder terminal and the main body feeder terminal because of the sliding of these terminals. Furthermore, by the movement of the unit positioning pin on the other side, restricting the position of the development unit and connecting the main body feeder terminal and the unit feeder terminal are completed at the same time, allowing an efficient operation with a simple configuration.

In addition, a seventh configuration of a color image forming apparatus according to the present invention includes a plurality of development units, each development unit having a toner for a different color, a developing member and a unit feeder terminal for supplying a voltage or an electric current necessary for an image formation, a carriage for supporting the plurality of development units so as to be attachable/removable with respect to an apparatus main body, a carriage driving system for rotating the carriage so as to move the plurality of development units sequentially and switch them between an image forming position and a waiting position, and a transfer system for transferring a toner image formed by the plurality of development units onto a printing medium. The apparatus includes an charge eliminating member for eliminating a residual electric charge in the development unit by contacting the unit feeder terminal directly when the development unit is located out of the image forming position. With this seventh configuration of the color image forming apparatus, when the development unit rotates after an image formation is finished, so that the unit feeder terminal contacts the main body feeder terminal in the image forming position again, it is possible to suppress the noise generation caused by the discharge of the residual electric charge in the development unit to the main body feeder terminal.

In the seventh configuration of the color image forming apparatus according to the present invention described above, it is preferable that the charge eliminating member is made of a flexible material with a resistance value of 1 kΩ to 10 MΩ and fixed to the apparatus main body so as to be grounded. With this preferable example, it is possible to eliminate electricity while avoiding a sudden discharge.

BEST MODE FOR CARRYING OUT THE INVENTION

In the following, the present invention will be described more specifically by way of an embodiment.

Figure 1:
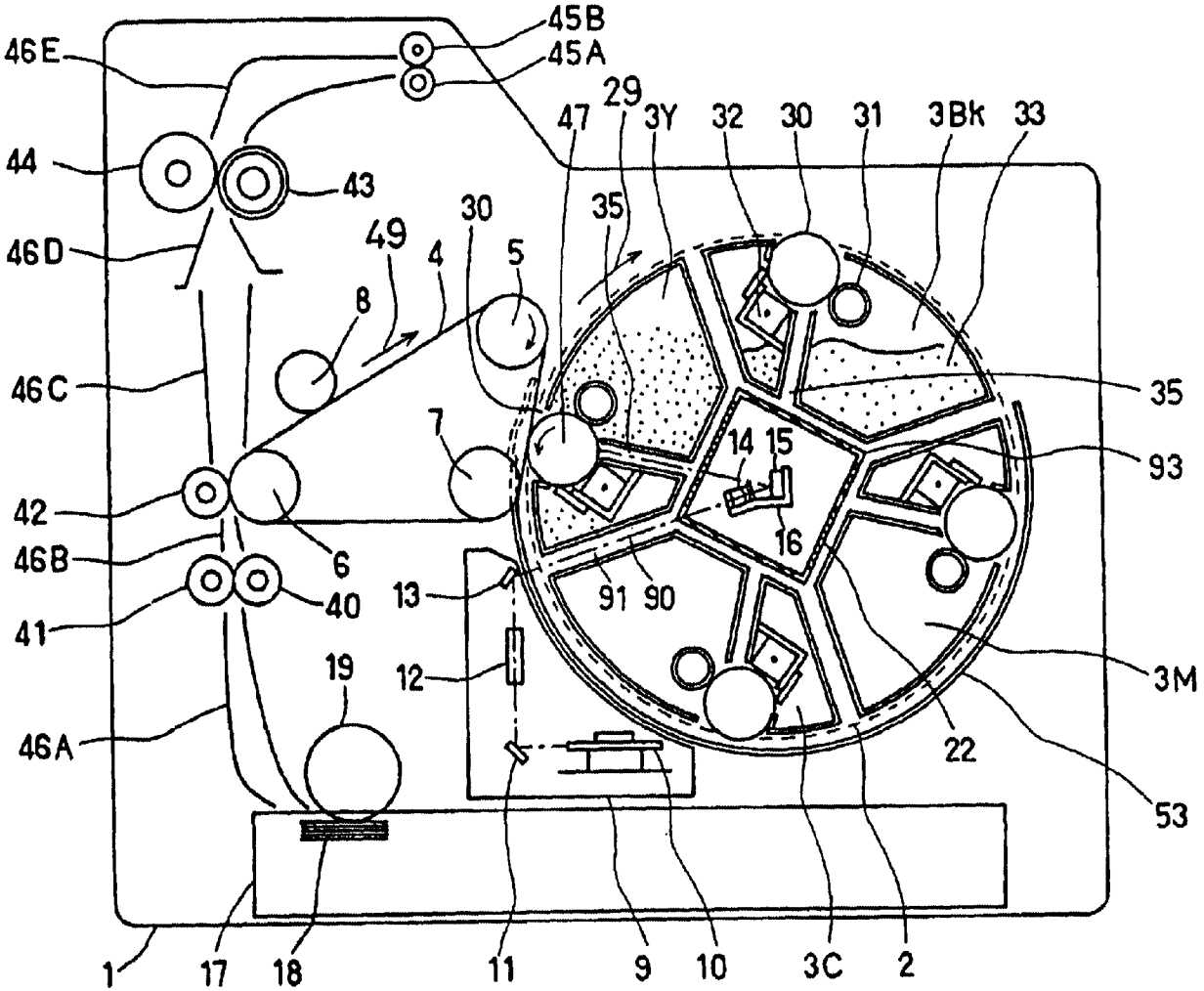
FIG. 1 is a schematic sectional view showing an overall configuration of a color image forming apparatus in one embodiment of the present invention.
Figure 2:
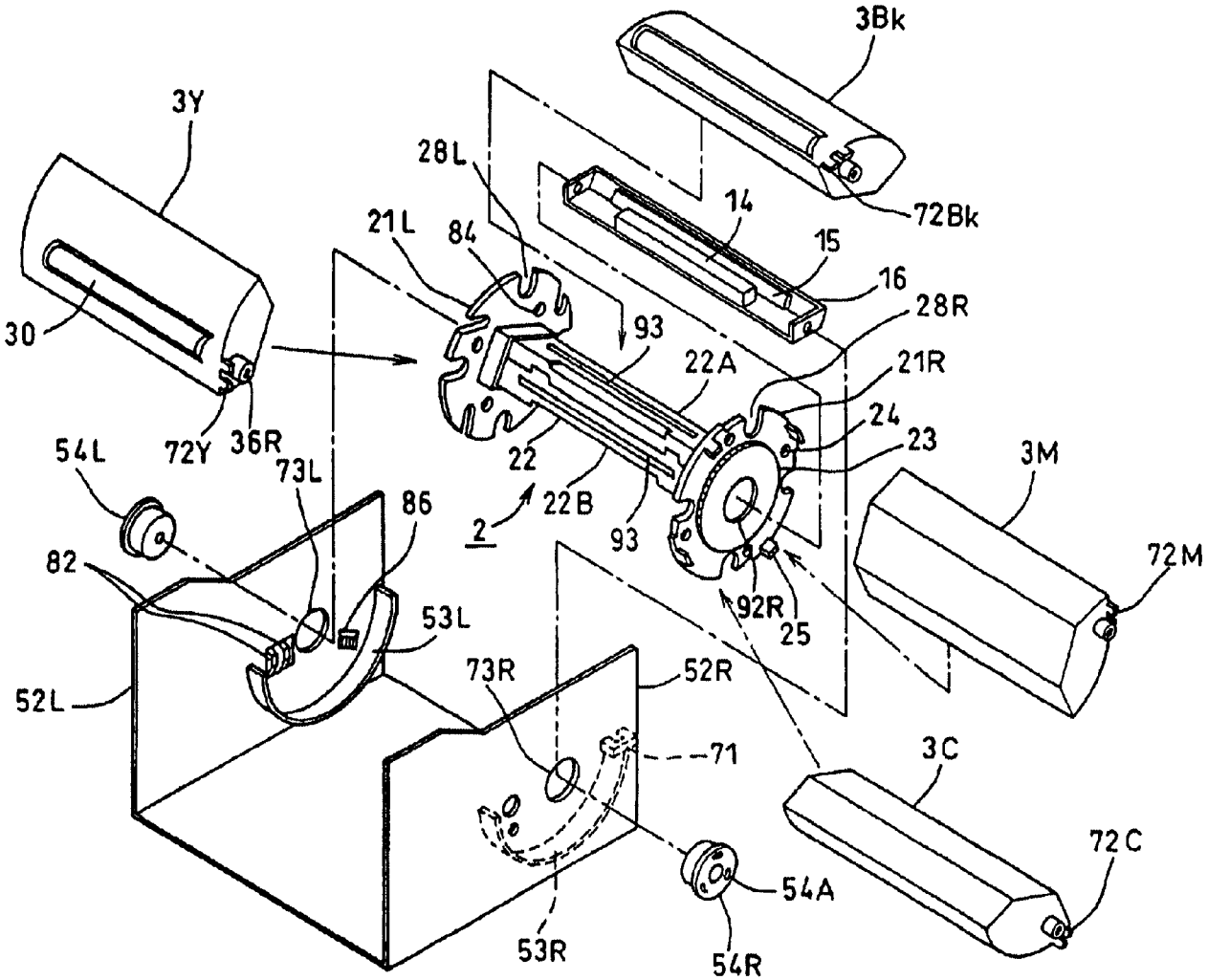
FIG. 2 is an exploded perspective view showing a configuration around a carriage of the color image forming apparatus in one embodiment of the present invention.
Figure 3:
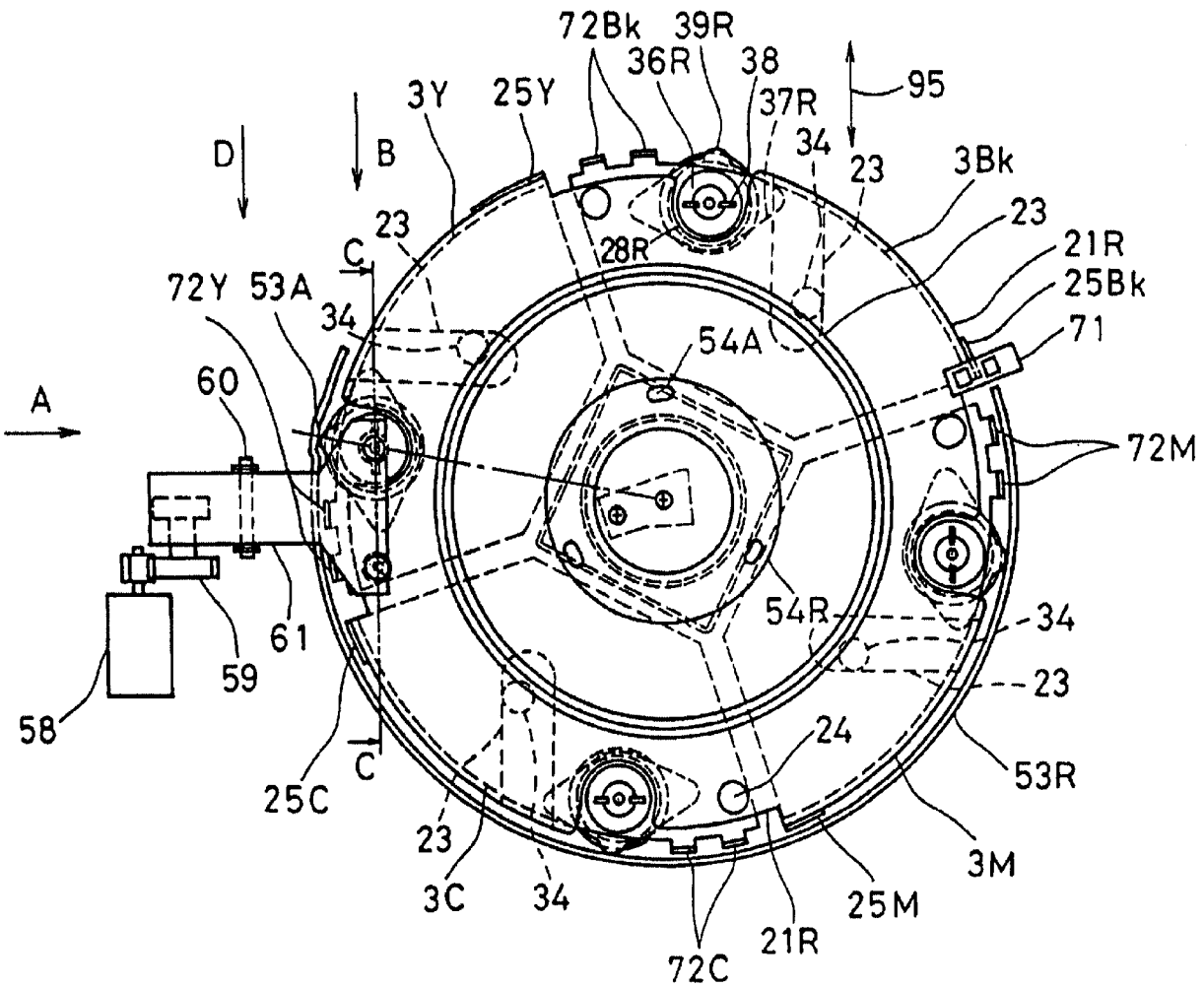
FIG. 3 is a right side view around the carriage of the color image forming apparatus in one embodiment of the present invention.
Figure 4:
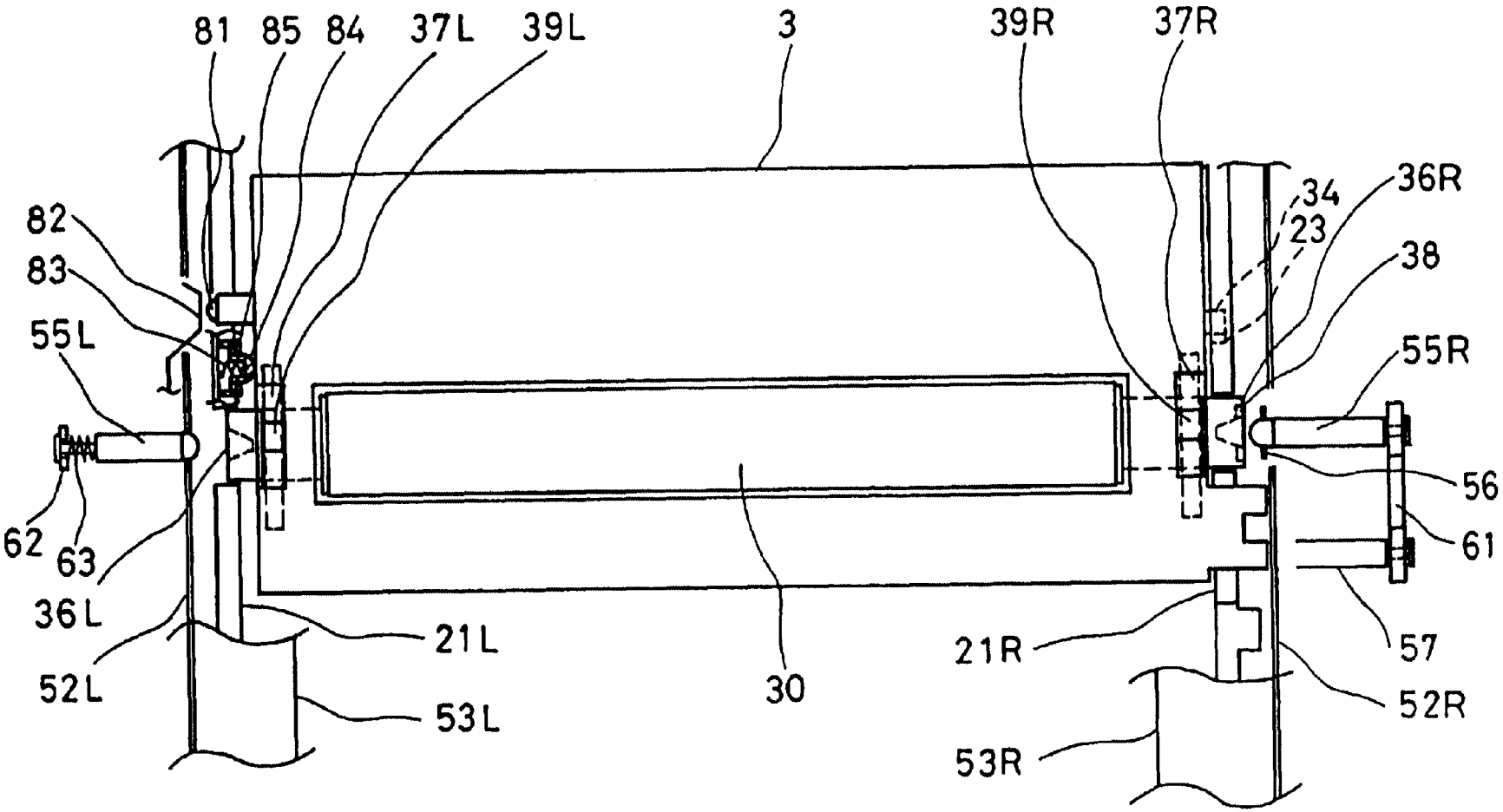
FIG. 4 is a view seen from a direction A in FIG. 3 when the positioning of a development unit is released.
Figure 5:
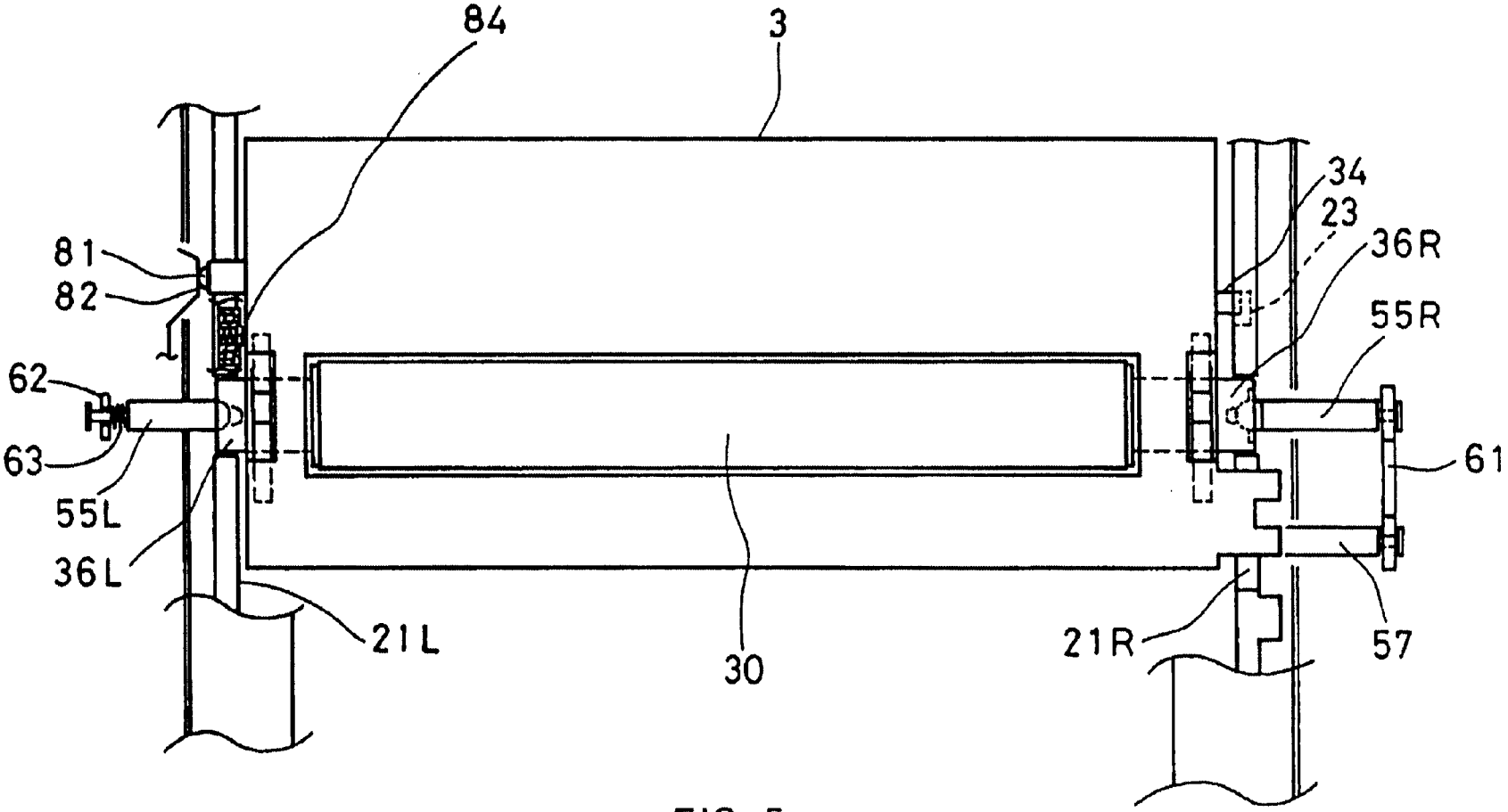
FIG. 5 is a view seen from the direction A in FIG. 3 when the development unit is positioned.
Figure 6:
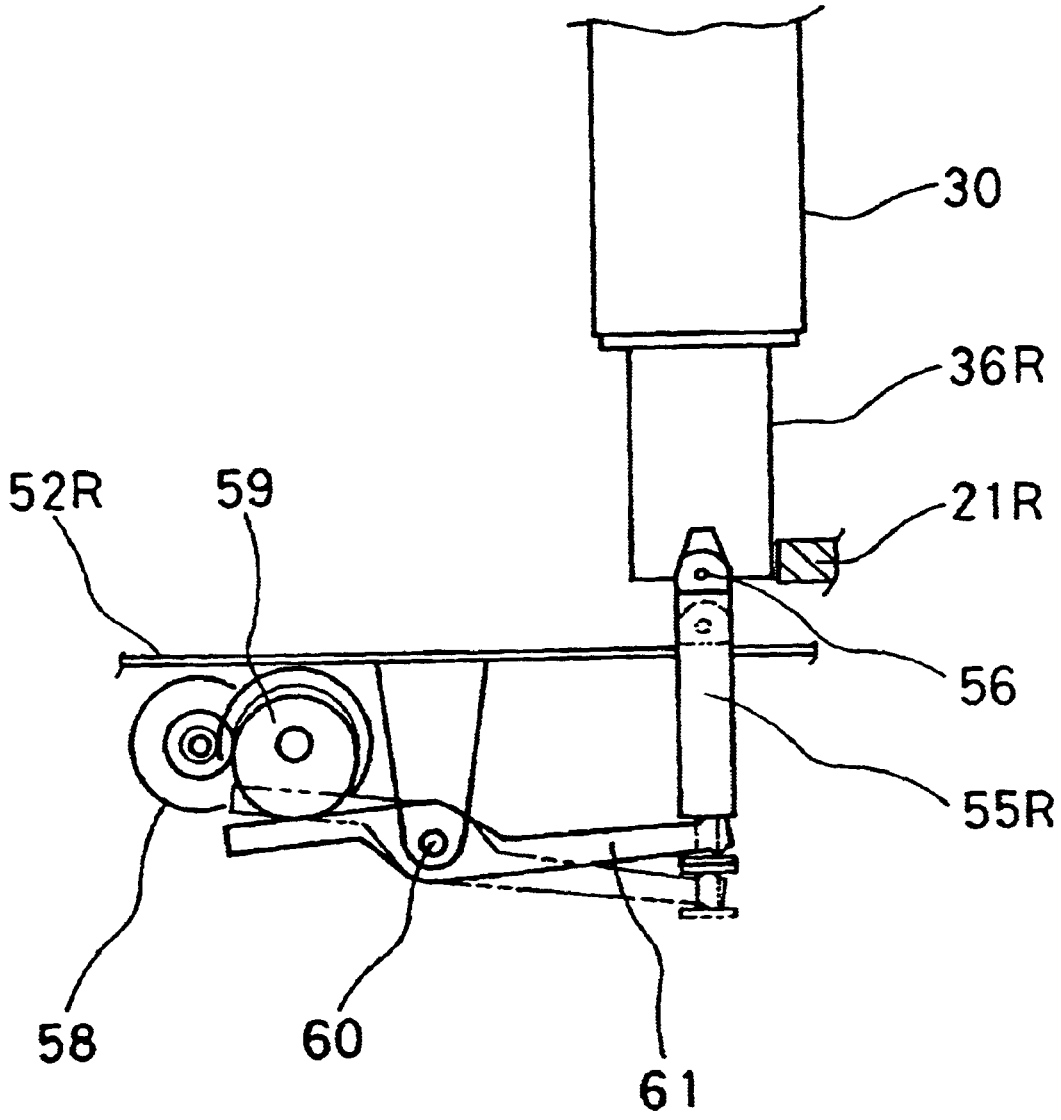
FIG. 6 is a view seen from a direction D in FIG. 3 showing a unit positioning mechanism and a carriage positioning mechanism of the color image forming apparatus in one embodiment of the present invention.
Figure 7:
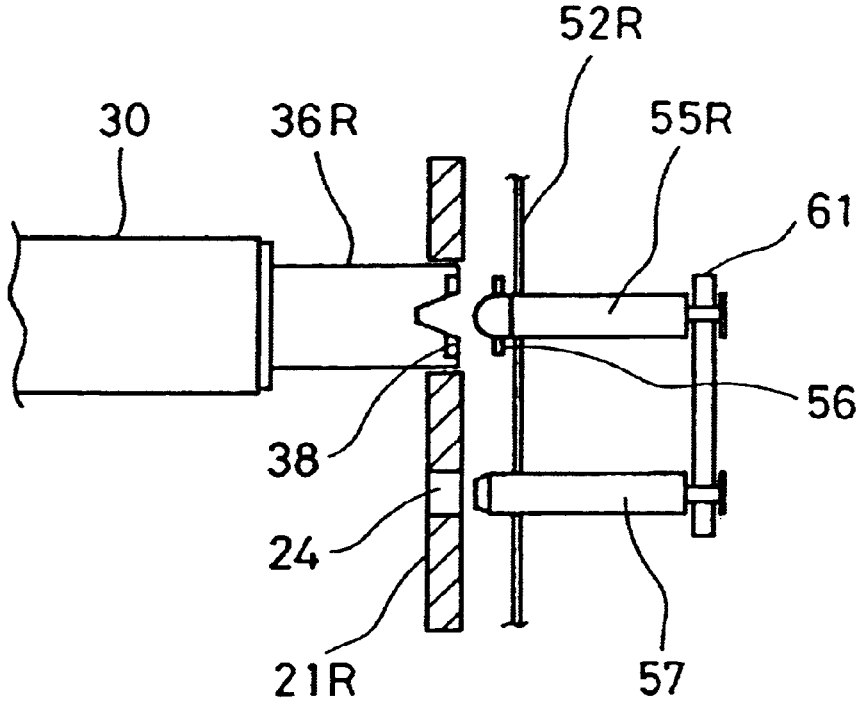
FIG. 7 is a sectional view taken along a line C—C in FIG. 3 showing the unit positioning mechanism and the carriage positioning mechanism of the color image forming apparatus in one embodiment of the present invention, with FIG. 7(A) showing the state in which the positioning of the development unit and the carriage is released, and FIG. 7(B) showing the state that they are positioned.
Figure 7:
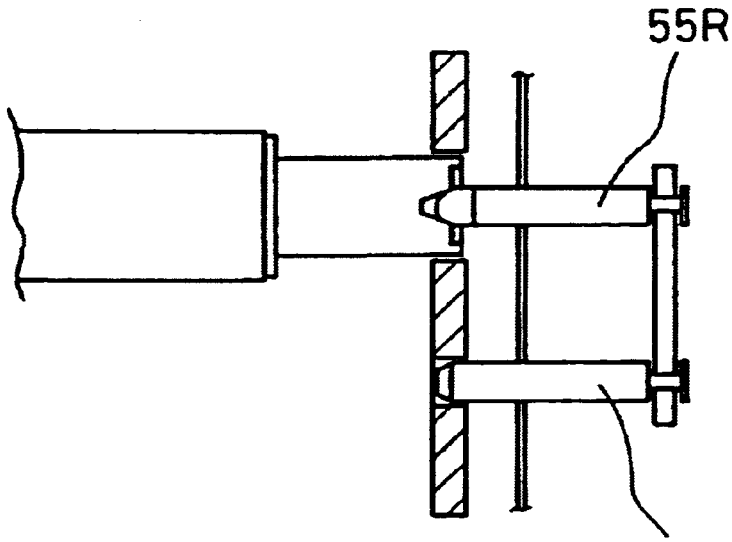
Figure 8:
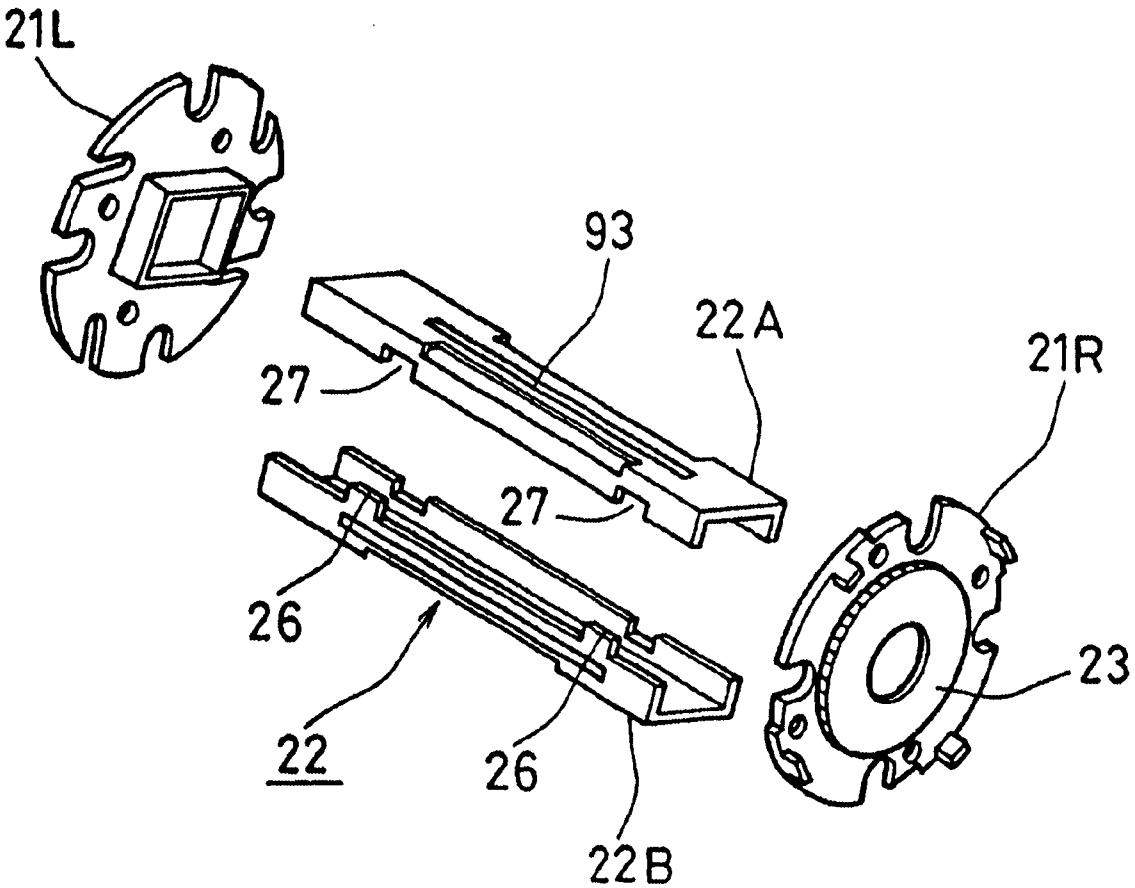
FIG. 8 is an exploded perspective view showing the carriage of the color image forming apparatus in one embodiment of the present invention.
Figure 9:
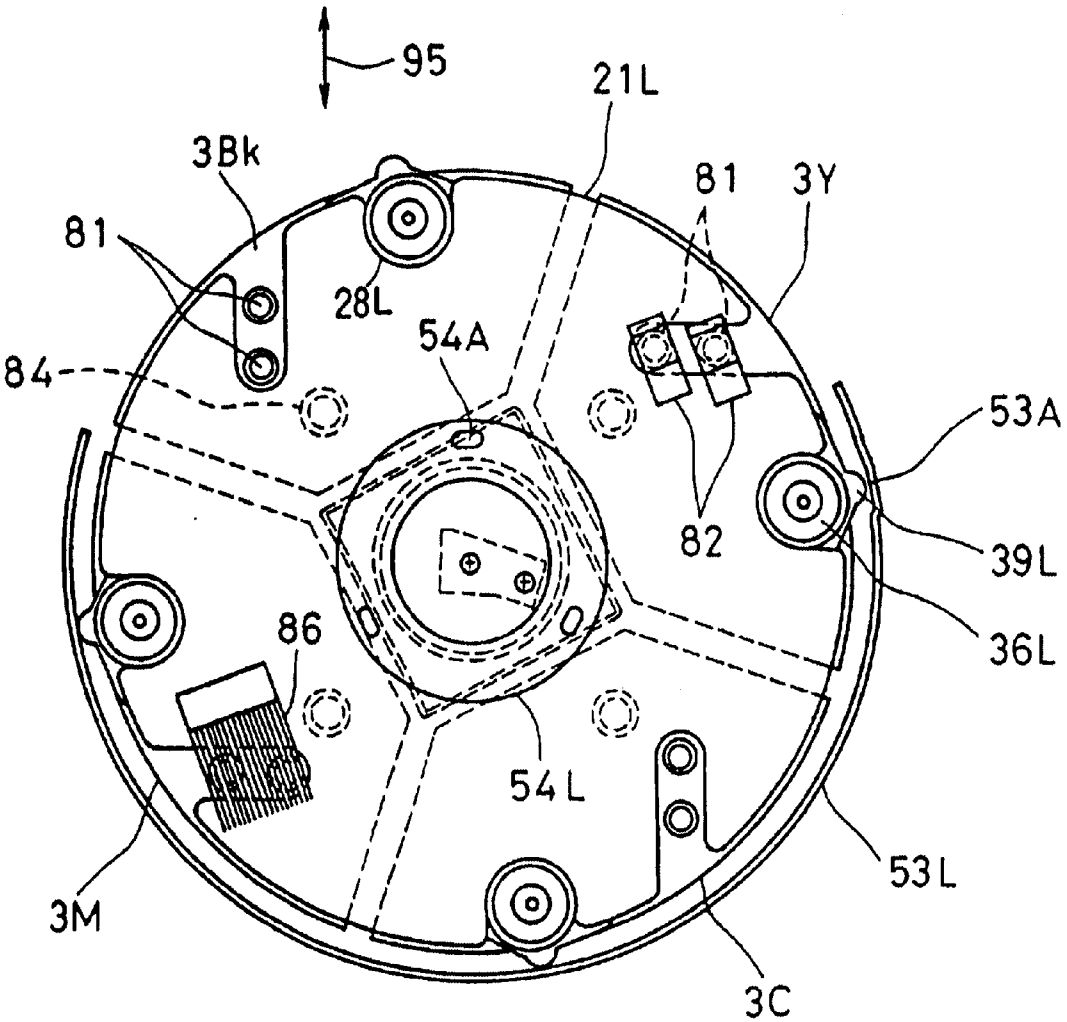
FIG. 9 is a left side view around the carriage of the color image forming apparatus in one embodiment of the present invention.

FIG. 1 is a schematic sectional view showing an overall configuration of a color image forming apparatus in one embodiment of the present invention; FIG. 2 is an exploded perspective view showing a configuration around a carriage of the color image forming apparatus in one embodiment of the present invention; FIG. 3 is a right side view around the carriage of the color image forming apparatus in one embodiment of the present invention; FIG. 4 is a view seen from a direction A in FIG. 3 when the positioning of a development unit is released; FIG. 5 is a view seen from the direction A in FIG. 3 when the development unit is positioned; FIG. 6 is a view seen from a direction D in FIG. 3 showing a unit positioning mechanism and a carriage positioning mechanism of the color image forming apparatus in one embodiment of the present invention; FIG. 7 is a sectional view taken along a line C—C in FIG. 3 showing the unit positioning mechanism and the carriage positioning mechanism of the color image forming apparatus in one embodiment of the present invention; FIG. 8 is an exploded perspective view showing the carriage of the color image forming apparatus in one embodiment of the present invention; and FIG. 9 is a left side view around the carriage of the color image forming apparatus in one embodiment of the present invention.

As shown in FIG. 1, substantially in the center of this color image forming apparatus, development units 3Y, 3C, 3M and 3Bk for yellow, cyan, magenta and black having a fan-shaped cross-section are arranged circularly, and they constitute a group of development units. Each of the development units 3 includes a photosensitive body 30, a developing roller 31 and a corona charger 32 that charges the photosensitive body 30 evenly with a negative voltage, and the photosensitive body 30 is exposed from an outer peripheral surface of the rotating development unit 3. The development units 3Y, 3C, 3M and 3Bk arranged circularly are supported by a carriage 2 so as to be attachable/removable with respect to a main body 1 of the apparatus. The carriage 2 includes left and right carriage side plates 21L and 21R that can position the development units 3 substantially and a pipe member 22 that links the carriage side plates 21L and 21R (see FIGS. 1, 2 and 8). A carriage gear 23 is formed integrally on the outer side of the carriage side plate 21R and linked to a carriage driving mechanism (not shown in this figure) provided on the side of the main body (see FIGS. 2 and 3). With such a configuration, it is possible to rotate the carriage 2 in an arrow 29 direction by the carriage driving mechanism, so as to move the photosensitive body 30 of the development unit 3 for each color sequentially between an image forming position 47 and other waiting positions, thereby switching the development units 3.

A laser beam scanner 9 is arranged in the vicinity of the carriage 2 and generates a signal light 90 as a laser beam modulated by an input signal. The laser beam scanner 9 includes a semiconductor laser (not shown in this figure), a polygon mirror 10, a first mirror 11, a first lens 12 and a second mirror 13. The signal light 90 emitted from the semiconductor laser travels via the polygon mirror 10, the first mirror 11, the first lens 12 and the second mirror 13, and goes through a light path 91 defined between the yellow development unit 3Y and the cyan development unit 3C in FIG. 1. The signal light 90 passes through a second lens 14 fixed to a support 16 inside the pipe member 22, enters a third mirror 15 fixed similarly to the support 16 so as to be reflected and pass through an opening 35 provided in the development unit 3Y, enters an exposure portion on the right side of the photosensitive body 30 that is located in the image forming position 47, thus scanning and exposing the photosensitive body 30 in a generating line direction. In this manner, a static latent image is formed on the photosensitive body 30 of the development unit 3Y.

Also, a toner 33 for each color is contained in the individual development unit 3. The toner 33 is a negatively charged toner made of polyester resin and pigment dispersed in the resin, and is supplied sequentially to the developing roller 31 and the photosensitive body 30 so as to develop the static latent image on the photosensitive body 30. In this manner, a toner image is formed on the photosensitive body 30.

In the color image forming apparatus of the present embodiment, a system of synthesizing a color image by overlapping toner images of respective colors mainly includes an intermediate transfer belt 4. This intermediate transfer belt 4 is provided for receiving the toner image formed on the photosensitive body 30 of the development unit 3 in the image forming position 47 and reforming the toner image on a recording paper sheet 18. The intermediate transfer belt 4 is formed of a resin film whose base material is an endless belt-like semiconducting (medium electrical resistance) polycarbonate having a thickness of 150 $\mu$m. This intermediate transfer belt 4 is stretched by rollers 5, 6 and 7 made of aluminum. The roller 5 is a driving roller for driving the intermediate transfer belt 4, and by the rotation of this driving roller 5, the intermediate transfer belt 4 can rotate and move in an arrow 49 direction in FIG. 1. The roller 7 is a tension roller for applying a tension to the intermediate transfer belt 4. The roller 6 is a backup roller for a secondary transfer roller 42 that transfers the toner image from the intermediate transfer belt 4 onto the recording paper sheet 18.

In the present embodiment, the circumference of the intermediate transfer belt 4 is set to be, for example, slightly greater than the longitudinal length of an A4 size sheet (about 297 mm) specified by JIS (Japanese Industrial Standard). The rollers 5, 6 and 7 are arranged so as to stretch the intermediate transfer belt 4. A portion of the intermediate transfer belt 4 between the rollers 5 and 7 is slightly pressed into contact with the photosensitive body 30.

In the state shown in FIG. 1, the rollers 5 and 7 are supplied with a voltage of +1 kV, thus carrying out a primary transfer from the photosensitive body 30 onto the intermediate transfer belt 4. In addition, the roller 6 is grounded electrically. The secondary transfer roller 42 for a secondary transfer onto the recording paper sheet 18 is arranged so as to face the roller 6 via the intermediate transfer belt 4. This secondary transfer roller 42 is formed of urethane foam whose surface has been treated to be low-resistance and can rotate in accordance with the rotation of the intermediate transfer belt 4. A bearing support mechanism of the secondary transfer roller 42 is arranged in two states, which are in the state of being pressed to achieve a slight contact with the intermediate transfer belt 4 so as to be rotatable in accordance with it and a waiting state of being away from the intermediate transfer belt 4. FIG. 1 shows the state where the secondary transfer roller 42 is pressed to achieve a slight contact with the intermediate transfer belt 4. A shaft of this secondary transfer roller 42 can be supplied with a voltage of about +700 V.

A paper feed unit 17 is arranged in a lower part of the apparatus main body 1, and from this paper feed unit 17, the recording paper sheet 18 can be supplied to a nip portion between the intermediate transfer belt 4 and the secondary transfer roller 42 by a paper feed roller 19.

In the vicinity of the intermediate transfer belt 4, a cleaner roller 8 for cleaning the intermediate transfer belt 4 is provided. The cleaner roller 8 is arranged in two states of press-contacting state and spaced-away state with respect to the intermediate transfer belt 4.

A fixing roller 43 and a pressure roller 44 are arranged downstream of the recording paper sheet 18 sent from the nip portion between the intermediate transfer belt 4 and the secondary transfer roller 42. The toner image on the recording paper sheet 18 after the secondary transfer is fixed by the fixing roller 43 and the pressure roller 44.

A transfer belt unit constituted by the intermediate transfer belt 4 and the rollers 5, 6 and 7 is positioned reliably at a predetermined position when installed in the apparatus main body 1, so that its portion facing the image forming position 47 contacts the photosensitive body 30 of the development unit 3. At the same time, each portion of the transfer belt unit is connected electrically to the main body side, and the driving roller 5 is linked to a driving system on the main body side, so that the intermediate transfer belt 4 becomes rotatable.

In FIG. 1, numeral 40 denotes a resist roller, numeral 41 denotes a resist pinch roller, numerals 45A and 45B denote paper ejection rollers, and numerals 46A, 46B, 46C, 46D and 46E denote paper guides.

As shown in FIG. 8, the pipe member 22 joining the carriage side plates 21L and 21R is formed of a hollow pipe member having a square cross-section perpendicular to a rotation axis of the carriage 2. The development units 3Y, 3C, 3M and 3Bk can be arranged along respective sides of the pipe member 22. The pipe member 22 is constituted by two-divided sheet-like pipe element members 22A and 22B, which are formed to have a substantially angular U-shaped cross-section perpendicular to the rotation axis of the carriage 2. On one longitudinal side of the pipe element member 22B, convex portions 26 are formed integrally near both ends thereof toward the pipe element member 22A, while on one longitudinal side of the pipe element member 22A, concave portions 27 fitting the convex portions 26 are formed integrally. Also on the other longitudinal sides of the pipe element members 22A and 22B, the convex portions 26 and the concave portions 27 respectively are formed integrally in a similar manner. By fitting the convex portions 26 and the concave portions 27 of the pipe element members 22A and 22B together, the hollow pipe member 22 can be formed. With such configuration of the pipe member 22, it is possible to achieve an inexpensive pipe member 22 using the pipe element members 22A and 22B, which can be manufactured in an inexpensive manner by a regular press working. When the pipe member 22 is twisted, these two pipe element members 22A and 22B can be prevented from sliding in a direction parallel to the rotation axis of the carriage 2, thereby improving the torsional stiffness of the pipe member 22 considerably.

As shown in FIGS. 1 to 3, on an inner side of left and right side plates 52L and 52R of the apparatus main body 1, guide rails 53L and 53R respectively are fixed for restricting a moving track of the development units 3Y, 3C, 3M and 3Bk during the rotation of the carriage 2. The guide rails 53L and 53R are formed to have a downwardly-bent arc shape whose center corresponds to the rotation center of the carriage 2, and both sides of the development unit 3 can be supported by these guide rails 53L and 53R. Because of such a configuration of the guide rails 53L and 53R, the guide rails 53L and 53R can be achieved with relatively small members. In addition, since a bisectional point of each of the guide rails 53L and 53R (the point bisecting the length of the arc-shaped guide rails 53L and 53R) is located lower than the rotation center of the carriage 2, the development unit 3 reliably can be prevented from dropping out.

As described above, on the inner side of the left and right side plates 52L and 52R of the apparatus main body 1, the guide rails 53L and 53R respectively are provided for restricting the moving track of the development units 3Y, 3C, 3M and 3Bk during the rotation of the carriage 2. Thus, since the development unit 3 can be rotated in such a manner as to be held between the carriage 2 and the guide rails 53L and 53R, the moving track of the development unit 3 is stabilized. Also, since a lock mechanism or the like for preventing the development unit 3 from dropping out of the carriage 2 becomes unnecessary, the development unit 3 can be attached or removed in a single action when it is located in an upper side of the carriage 2. When one of the development units 3Y, 3C, 3M and 3Bk (the development unit 3Y in the case of FIGS. 1 and 3) is positioned at the image forming position 47, one of the remaining three development units 3 (the development unit 3Bk in the case of FIGS. 1 and 3) is located outside the fan-shape formed by the rotation center of the carriage 2 and the guide rails 53L and 53R so as to be removable from/attachable to the apparatus main body 1 along an arrow 95 direction. Therefore, the development unit 3 can be removed only by lifting it up and attached only by dropping it in.

The left and right side plates 52L and 52R of the apparatus main body 1 are provided with round holes 73L and 73R at a position corresponding to the rotation center of the carriage 2. The carriage 2 is arranged between the left and right side plates 52L and 52R of the apparatus main body 1. Then, while round holes 92L and 92R made in the center of the left and right carriage side plates 21L and 21R (the round hole 92L is not shown in this figure) and the round holes 73L and 73R of the left and right side plates 52L and 52R of the apparatus main body 1 are in agreement, carriage rotating shaft members 54L and 54R are inserted in the round holes 92L and 92R from an outer side of the left and right side plates 52L and 52R of the apparatus main body 1, thereby supporting the carriage 2 rotatably. Also, the interior of the hollow pipe member 22 is provided with the second lens 14 for image formation and the third mirror 15 that are fixed to the support 16 and serve as element members of the laser beam scanner 9. The support 16 is fixed to the left and right side plates 52L and 52R of the apparatus main body 1 via the carriage rotating shaft members 54L and 54R. In other words, independent of the rotation of the carriage 2, the second lens 14 for image formation and the third mirror 15 are arranged inside the rotational moving track of the development units 3Y, 3C, 3M and 3Bk. Since the second lens 14 for image formation and the third mirror 15 serving as the element members of the laser beam scanner 9 are arranged inside the rotational moving track of the development units 3Y, 3C, 3M and 3Bk as described above, compact apparatus can be achieved. In this case, the third mirror (reflecting mirror) 15 is fixed to the apparatus main body 1 via the support 16 and the carriage rotating shaft members 54L and 54R as described above. However, because the development units 3Y, 3C, 3M and 3Bk are configured to rotate while being supported by the carriage 2, by directly fixing the third mirror (the reflecting mirror) 15 to the carriage rotating shaft members 54L and 54R, which support the rotation axis of the carriage 2, at a position substantially matching the rotation axis of the carriage 2, it is possible to minimize an error of the attachment position of the third mirror (the reflecting mirror) 15. In addition, the hollow pipe member 22 is provided with exposure windows 93 at the total of eight positions through which the signal light 90 for exposing the photosensitive body passes. Furthermore, the carriage rotating shaft members 54L and 54R respectively are provided with three arc-shaped long holes 54A for screwing so as to be spaced away from each other by 120°. With these long holes 54A, the carriage rotating shaft members 54L and 54R can be attached rotatably to the left and right side plates 52L and 52R of the apparatus main body 1. With such a configuration, when the third mirror (the reflecting mirror) 15 is fixed to the carriage rotating shaft members 54L and 54R via the support 16 at the position matching the rotation axis of the carriage 2, the angle of the third mirror (the reflecting mirror) 15 can be adjusted simply by rotating the carriage rotating shaft members 54L and 54R. Thus, it is not necessary to add another component for the angle adjustment, contributing to a cost reduction.

As shown in FIGS. 3 and 4, flanges 36L and 36R are fixed to left and right ends of the photosensitive bodies 30 of the development units 3Y, 3C, 3M and 3Bk and supported rotatably by photosensitive body bearings 37L and 37R. The photosensitive body bearings 37L and 37R integrally are provided with development unit guide portions 39L and 39R that slide in contact with the guide rails 53L and 53R during the rotation of the carriage 2. These development unit guide portions 39L and 39R are arranged so as to protrude along a line connecting the rotation center of the carriage 2 and that of the photosensitive body 30. Accordingly, while avoiding the contact of the exposed photosensitive body 30 with the guide rails 53L and 53R and other components on the main body side, it is possible to restrict the moving track of the development units 3Y, 3C, 3M and 3Bk reliably during the rotation of the carriage 2. It also is possible to minimize the length along which the photosensitive body 30 slides over the intermediate transfer belt 4 during the rotation of the carriage 2 (the toner image cannot be transferred and formed onto the portion of the intermediate transfer belt 4 over which the photosensitive body 30 slides, and thus this portion becomes a unprintable region). A concave portion 53A is formed in the portion of the guide rails 53L and 53R corresponding to the image forming position 47 so that the development unit guide portions 39L and 39R do not contact the guide rails 53L and 53R when the development unit 3 is positioned at the image forming position 47 by a unit positioning system described below and forms an image. Accordingly, the development unit 3 as well as the development unit guide portions 39L and 39R can be prevented from contacting the guide rails 53L and 53R at the image forming position 47, allowing an accurate positioning of the development unit 3. Moreover, it is possible to prevent an external force inhibiting an excellent image formation from being applied to the development unit 3.

As shown in FIGS. 2, 3 and 4, the flanges 36L and 36R that are fixed to the left and right ends of the photosensitive body 30 are provided with a tapered bore for positioning the development unit 3. Also, the flanges 36L and 36R are inserted into U-shaped grooves 28L and 28R provided in the carriage side plates 21L and 21R, thereby positioning the development unit 3 substantially with respect to the carriage 2. The development unit 3 itself is supported in the carriage 2 so as to be capable of reciprocating in a direction parallel to the rotation axis of the carriage 2. Furthermore, while being inserted through the left and right side plates 52L and 52R of the apparatus main body 1, unit positioning pins 55L and 55R that can reciprocate in the direction parallel to the rotation axis of the carriage 2 are arranged on the left and right sides of the photosensitive body 30 located at the image forming position 47. On the other hand, at the tip of the unit positioning pin 55R, a latching pin 56 is provided perpendicularly thereto, while at the tip of the flange 36R, a latching groove 38 into which the latching pin 56 latches is provided. Thus, when a predetermined development unit 3 is located in the image forming position 47 by the rotation of the carriage 2, by moving the unit positioning pins 55L and 55R inward so as to engage the tapered bores of the left and right-end flanges 36L and 36R fixed to the photosensitive body 30 and by latching the latching pin 56 of the unit positioning pin 55R into the latching groove 38 on the side of the photosensitive body 30, the predetermined development unit 3 can be positioned at a normal position with respect to the apparatus main body 1 in the image forming position 47 (the state shown in FIG. 5).

After the development unit 3 is positioned in the image forming position 47 as described above, the unit positioning pin 55R is rotationally driven via a driving mechanism, which is not shown in this figure, whereby torque is transmitted to the photosensitive body 30 via the latching pin 56, so that the photosensitive body 30 rotates counter clockwise in FIG. 3 so as to form an image.

When the photosensitive body 30 is rotationally driven, a rotational force toward the same direction as the rotation direction of the photosensitive body 30 around the rotation axis of the photosensitive body 30 is exerted to the development unit 3. However, since a stopper pin 34 provided on the right side of the development unit 3 contacts a side wall of a stopper groove 23 provided on an inner wall surface of the carriage side plate 21R, the development unit 3 is prevented from rotating. This prevents the development unit 3 from contacting the guide rails 53L and 53R. As described above, the photosensitive body 30 of the development unit 3 is positioned with respect to the apparatus main body 1 using the unit positioning pins 55L and 55R, and the rotation of the development unit 3 around the photosensitive body 30 is prevented using the stopper pin 34 and the stopper groove 23, making it possible to form an image by rotating the photosensitive body 30 while supporting it stably at a predetermined position. Also, since it becomes unlikely that the photosensitive body 30 is subjected to external forces or vibrations during its rotation, an excellent image formation can be achieved. As shown in FIG. 3, the stopper groove 23 is formed in parallel with the attaching/removing direction 95 of a development unit located in an attaching/removing position (the development unit 3Bk in FIG. 3) so that it can guide the stopper pin 34 when attaching/removing the development unit.

Furthermore, a carriage positioning pin 57 is provided in parallel with the unit positioning pin 55R and inserted through the right side plate 52R of the apparatus main body 1. Also, the carriage side plate 21R is provided with engaging holes 24 that engage the carriage positioning pin 57. By positioning the predetermined development unit 3 using the unit positioning pin 55R at the normal position with respect to the apparatus main body 1 in the image forming position 47 and engaging the carriage positioning pin 57 into the engaging hole 24 of the carriage side plate 21R, the carriage 2 can be positioned at a normal position with respect to the apparatus main body 1.

When the predetermined development unit 3 (the development unit 3Y in FIG. 3) and the carriage 2 are positioned, other development unit 3 (the development unit 3Bk in FIG. 3) can be attached to or removed from the apparatus main body 1. Therefore, the attachment/removal of the development unit 3 and the image formation are possible in one carriage stopping position, eliminating the need for providing another carriage stopping position for the attachment/removal of the development unit 3, allowing a simple control. In addition, the attachment/removal of the development unit 3 is not prevented by an accompanying rotation of the carriage 2.

In the waiting state of the apparatus, the carriage 2 also is fixed while being positioned. Accordingly, simply by opening an upper cover of the apparatus in the waiting state, the development unit 3 can be replaced. In addition, there is no concern of rotating the carriage 2 by mistake when opening the upper cover of the apparatus in the waiting state.

The following is a description of a mechanism for reciprocating the unit positioning pins 55L and 55R and the carriage positioning pin 57 in the direction parallel to the rotation axis of the carriage 2. The unit positioning pin 55R and the carriage positioning pin 57 will now be described as an example. As shown in FIGS. 3, 6 and 7, rear ends of the unit positioning pin 55R and the carriage positioning pin 57 are linked to one end of a lever 61 provided on the right side plate 52R of the apparatus main body 1 so as to be pivotable on a pin 60. The lever 61 constantly is forced toward the direction in which the unit positioning pin 55R is spaced away from the tapered bore of the photosensitive body 30. The other end of the lever 61 contacts an eccentric cam 59 for pivoting the lever 61, and the cam 59 can be rotated by a motor 58. Thus, by rotating the cam 59 by the motor 58, the lever 61 can be pivoted so as to reciprocate the unit positioning pin 55R and the carriage positioning pin 57 in the direction parallel to the rotation axis of the carriage 2. With the above configuration, two members, namely, the development unit 3 and the carriage 2 can be positioned by a single driving source (the motor 58) and transmitting members (the cam 59 and the lever 61), achieving a simple configuration. The reciprocating movement of the unit positioning pin 55L also is carried out by a mechanism similar to the above.

As described above, since the development unit 3 and the carriage 2 can be positioned with respect to the apparatus main body 1 in the image forming position 47, even when a rotational force is applied to the carriage 2 during a printing operation, it is possible to keep the carriage 2 at an accurate position. In addition, since the positioning mechanism is provided independently of the carriage driving mechanism, a positional accuracy of the stopping position required for the carriage driving mechanism is eased.

As shown in FIGS. 2 and 3, convex portions 25Y, 25C, 25M and 25Bk for carriage position detection are formed integrally with the outermost peripheral portion of the carriage side plate 21R so as to correspond to the development units 3Y, 3C, 3M and 3Bk. The convex portions 25Y, 25C, 25M and 25Bk for carriage position detection can be detected by a position detection sensor 71 provided on the right side plate 52R of the apparatus main body 1. The convex portion 25Y for carriage position detection has a different shape from the convex portions 25C, 25M and 25Bk for carriage position detection. In other words, the convex portion 25Y for carriage position detection is set to be longer in a circumferential direction of the carriage 2 than the convex portions 25C, 25M and 25Bk for carriage position detection. Since the shape of the convex portion 25Y for carriage position detection is made different from that of the convex portions 25C, 25M and 25Bk for carriage position detection as described above, it is possible to detect an origin of one rotation of the carriage 2 by the single position detection sensor 71, allowing a color detection.

Convex portions 72Y, 72C, 72M and 72Bk for unit detection are formed integrally with right end faces of the development units 3Y, 3C, 3M and 3Bk perpendicular to the rotation axis of the carriage 2. These convex portions 72Y, 72C, 72M and 72Bk for unit detection are formed at substantially the same distance from the rotation center of the carriage 2 as the convex portions 25Y, 25C, 25M and 25Bk for carriage position detection so as to be detected by the position detection sensor 71. The convex portions 72Y, 72C, 72M and 72Bk for unit detection have a different shape from the convex portions 25Y, 25C, 25M and 25Bk for carriage position detection. In other words, the convex portions 72Y, 72C, 72M and 72Bk for unit detection are set to be shorter than the convex portions 25Y, 25C, 25M and 25Bk for carriage position detection. Furthermore, one convex portion 25Y, 25C, 25M or 25Bk for carriage position detection each is provided for the respective development unit 3Y, 3C, 3M or 3Bk, while a plurality (two in this embodiment) of the convex portions 72Y, 72C, 72M or 72Bk for unit detection can be provided for the respective development unit 3Y, 3C, 3M or 3Bk. Since the shape of the convex portions 72Y, 72C, 72M and 72Bk for unit detection is made different from that of the convex portions 25Y, 25C, 25M and 25Bk for carriage position detection as described above, it is possible to discriminate between the detection of the carriage 2 position and that of the presence of the development unit 3. Also, the configuration in which a plurality of the convex portions 72Y, 72C, 72M or 72Bk for unit detection can be provided for the respective development unit 3Y, 3C, 3M or 3Bk makes it possible to detect information concerning the development unit 3, for example, a difference in a contained toner and photosensitive body sensitivity and that of an intended use.

For example, in the development unit 3C in FIG. 3, it becomes possible to detect information such that two successive convex portions 72C for unit detection provided in the rotation direction of the carriage 2 indicates that a high-sensitivity photosensitive body is contained, only one convex portion 72C provided in the downstream of the rotation direction of the carriage 2 indicates that a medium-sensitivity photosensitive body is contained, and only one convex portion 72C provided in the upstream indicates that a low-sensitivity photosensitive body is contained.

Since the convex portions for position detection are formed integrally on the carriage 2 and the development unit 3 as described above, it is possible to detect the position of the carriage 2 and the presence of the development unit 3 without an additional component.

As shown in FIGS. 2, 4 and 9, on the left end faces of the development units 3Y, 3C, 3M and 3Bk perpendicular to the rotation axis of the carriage 2, unit feeder terminals 81 for supplying a voltage or an electric current necessary for an image formation are provided. Also, cantilevered main body feeder terminals 82 like a plate spring are provided on the left side plate 52L of the apparatus main body 1 at positions facing the unit feeder terminals 81 of the development unit 3 located in the image forming position 47. Furthermore, on an inner surface of the carriage side plate 21L, a unit slide pin 84 that is forced by a unit slide spring 83 is provided corresponding to each of the development units 3Y, 3C, 3M and 3Bk (see FIG. 9). Thus, each of the development units 3Y, 3C, 3M and 3Bk normally is forced within the carriage 2 in a direction in which the unit feeder terminals 81 and the main body feeder terminals 82 are spaced away from each other (rightward in FIG. 4). In FIG. 4, numeral 85 denotes a stopper for holding the unit slide pin 84 on the inner surface of the carriage side plate 21L. When the predetermined development unit 3 is positioned by the unit positioning pins 55L and 55R in the image forming position 47, the development unit 3 slides leftward in FIG. 4 against a spring force of the unit slide pin 84, so that the main body feeder terminals 82 directly contact the unit feeder terminals 81 of the predetermined development unit 3, thus feeding electricity to the development unit 3 (see FIG. 5).

Figure 10:
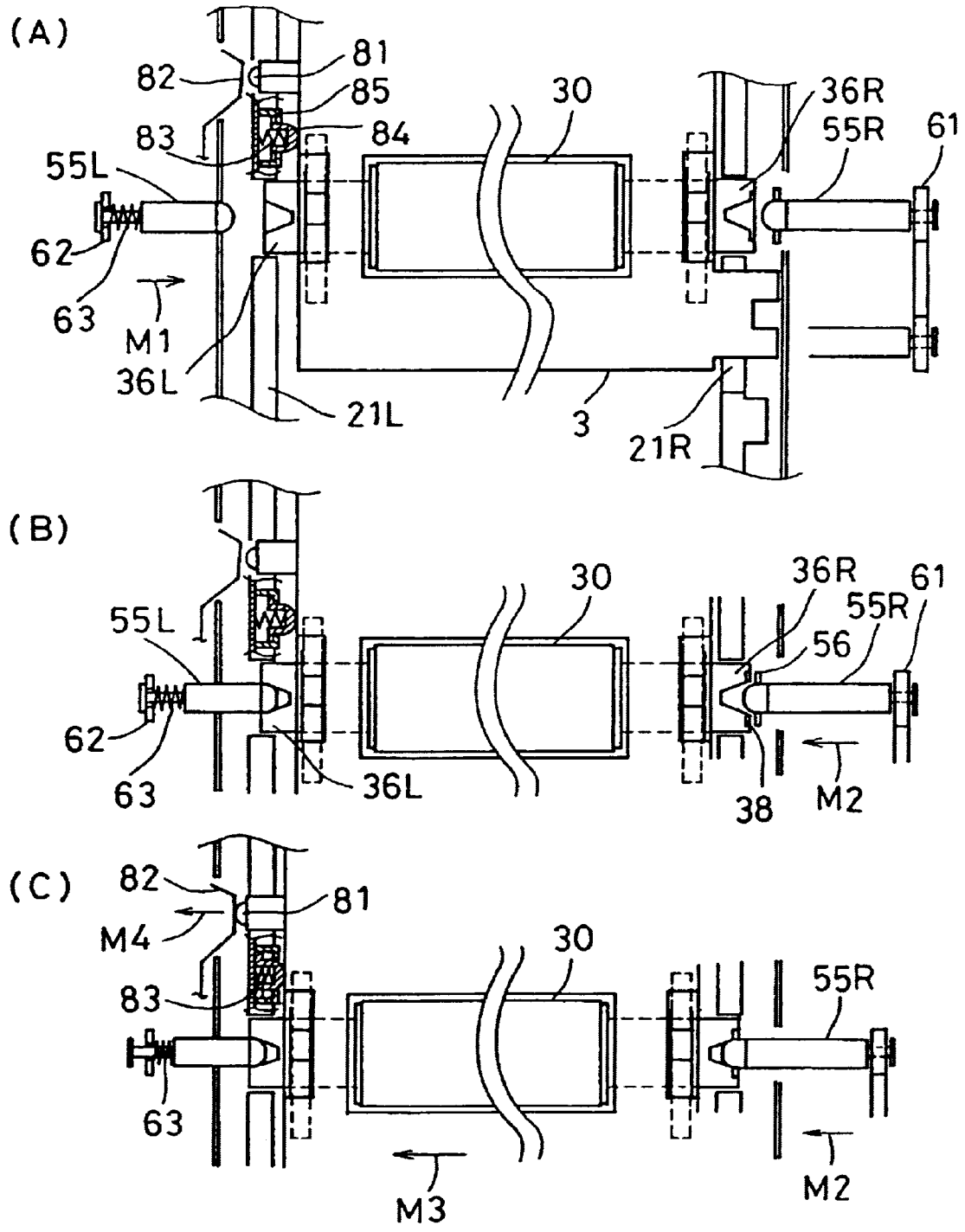
FIGS. 10(A) to 10(C) are schematic views showing a unit positioning operation of the color image forming apparatus in one embodiment of the present invention.

The following is a description of an operation, after the predetermined development unit 3 moves to the image forming position 47 by the rotation of the carriage 2 to reach the state shown in FIG. 4, until it is positioned in the state shown in FIG. 5 by the unit positioning pins 55L and 55R, with reference to FIG. 10.

FIG. 10(A) shows the state immediately after the development unit 3 has moved to the image forming position 47, which is the same as that in FIG. 4. In this state, the unit feeder terminals 81 and the main body feeder terminals 82 are spaced away from each other by the force of the unit slide spring 83 as described above. Also, the unit positioning pin 55R on the right is supported by the lever 61 as shown in FIGS. 6 and 7. On the other hand, the unit positioning pin 55L on the left is supported by a lever 62 via a compression coil spring 63. The compression coil spring 63 has a spring coefficient sufficient for restricting the position of the development unit 3 in the horizontal direction of the sheet. In this state, first, the lever 62 is driven to move the left unit positioning pin 55L in an arrow M1 direction (the rightward direction of the sheet). Then, as shown in FIG. 10(B), the driving of the lever 62 is stopped at the position where the tip of the positioning pin 55L substantially is in contact with the tapered bore of the flange 36L. Subsequently, the lever 61 is driven to move the right unit positioning pin 55R in an arrow M2 direction (the leftward direction of the sheet). The unit positioning pin 55R intrudes into the tapered bore of the flange 36R, so that the latching pin 56 fits into the latching groove 38 formed on the end of the flange 36R. Then, the positioning pin 55R further is moved in the arrow M2 direction. As a result, as shown in FIG. 10(C), the development unit 3 moves in an arrow M3 direction (the leftward direction of the sheet) against an elastic force of the unit slide spring 83 and the compression coil spring 63. Simultaneously, the unit feeder terminals 81 begin to contact the main body feeder terminals 82, and then the main body feeder terminals 82 are pushed further in an arrow M4 direction. Then, the movement of the unit positioning pin 55R stops so that the development unit 3 is positioned at a normal position in the image forming position 47 (the state shown in FIG. 5). As described above, the unit positioning pin 55L on the side of the main body feeder terminals 82 first is moved to contact the development unit 3 and restrict its position substantially, and then the unit positioning pin 55R on the opposite side is moved to slide the development unit 3 so as to complete the positioning. Consequently, the deformation amount of the main body feeder terminals 82 is the largest when the positioning of the development unit 3 is completed, so that the main body feeder terminals 82 are not deformed too much in a positioning process of the development unit 3. Thus, it is possible to suppress a sliding distance of the unit feeder terminals 81 on the main body feeder terminals 82 to a necessary minimum during the deformation of the main body feeder terminals 82. Contrary to the above, it is now assumed that the unit positioning pin 55R first is moved in the arrow M2 direction from the state shown in FIG. 10(A) so that the development unit 3 slides in the leftward direction of the sheet, and then the unit positioning pin 55L is moved in the arrow M1 direction. In this case, there is a possibility that, by a leftward inertial force of the development unit 3 caused by the movement of the unit positioning pin 55R, the development unit 3 moves leftward beyond a predetermined position so as to push the main body feeder terminals 82 too much. As a result, the main body feeder terminals 82 are deformed plastically or broken. Although the development unit 3 can be moved rightward from this state by the unit positioning pin 55L so as to return to the normal position, the reciprocating movement of the development unit 3 increases the sliding distance of the unit feeder terminals 81 on the main body feeder terminals 82, leading to more abrasion of these terminals.

As described above, the development unit 3 itself is supported in the carriage 2 so as to be capable of reciprocating in the direction parallel to the rotation axis of the carriage 2. When moving the unit positioning pins 55L and 55R inward so as to position the predetermined development unit 3 at the normal position with respect to the apparatus main body 1 in the image forming position 47, the development unit 3 moves leftward in FIG. 4, so that the unit feeder terminals 81 of the development unit 3 contact the main body feeder terminals 82. Thus, since the unit feeder terminals 81 and the main body feeder terminals 82 do not contact each other or contact with a slight contact pressure during the rotation of the carriage 2, it is possible to suppress a change in characteristics in the terminal surface caused by abrasion and noise generation caused by friction. In addition, since the unit feeder terminals 81 are brought into contact with the main body feeder terminals 82 while being connected with the positioning system of the development unit 3, it is possible to achieve the connection of the both terminals without any driving source exclusively for this purpose.

Moreover, by supporting the development unit 3 in the carriage 2 so as to be capable of moving in the direction parallel to the rotation axis of the carriage 2 and further increasing a moving stroke of the development unit 3, it also is possible to support the unit positioning pin 55L so as to be fixed to the apparatus main body 1 without driving and reciprocating it as in the present example. This increases the stiffness of the positioning mechanism and improves the positioning accuracy. In addition, a simple configuration of the positioning mechanism can be achieved, leading to a manufacture at a low cost.

As shown in FIG. 9, on the left side plate 52L of the apparatus main body 1, a charge eliminator 86 is provided for eliminating a residual electric charge in the development unit 3 by directly contacting the unit feeder terminals 81 of the development unit 3 located out of the image forming position 47. Thus, when the development unit 3 rotates after an image formation is finished, so that the unit feeder terminals 81 contact the main body feeder terminals 82 in the image forming position 47 again, it is possible to suppress the noise generation caused by the discharge of the residual electric charge in the development unit 3 to the main body feeder terminals 82. In this embodiment, the charge eliminator 86 is made of a flexible material with a resistance value of 1 kΩ to 10 MΩ (more specifically, a polyester film containing carbon or a charge eliminating brush made of nylon fiber whose surface is coated with an electrically conductive polymer having an electron conjugated system) and fixed to the left side plate 52L of the apparatus main body 1 so as to be grounded. This makes it possible to eliminate charges while avoiding a sudden discharge.

Next, the following is a description of an image formation using a color image forming apparatus with the above configuration.

When a power source of the apparatus main body 1 is turned on while the transfer belt unit and the development unit 3 for each color are mounted at their predetermined positions, the fixing device 43 is heated up, and the polygon mirror 10 of the laser beam scanner 9 begins rotating, thus completing preparations. An initialize mode for maintenance of the photosensitive body 30 and the intermediate transfer belt 4 may be operated immediately after turning on the power source.

When the preparations are completed, first, the image formation by the yellow development unit 3Y at the image forming position 47 begins (the state shown in FIG. 1). Then, at the same time that the yellow photosensitive body 30 linked to the driving source of the apparatus main body 1 begins rotating at the image forming position 47, the developing roller 31, the corona charger 32 and the intermediate transfer belt 4 begin operating. The driving roller 5 is driven from the side of the apparatus main body 1, and its friction force rotates the intermediate transfer belt 4 in the arrow 49 direction. In this embodiment, the peripheral velocity of the photosensitive body 30 is designed to be substantially the same as that of the intermediate transfer belt 4. In addition, the secondary transfer roller 42 and the cleaner roller 8 are spaced away from the intermediate transfer belt 4 at this time.

When the portion of the surface of the photosensitive body 30 that is charged evenly by the corona charger 32 reaches the exposing position, a detection system (not shown in this figure) detects a home position of the intermediate transfer belt 4. In synchronization with this detected signal, the laser beam scanner 9 irradiates the signal light 90 to the photosensitive body 30. When the signal light 90 is irradiated onto the evenly charged photosensitive body 30, a static latent image is formed according to an image signal, and then this static latent image is made manifest sequentially, so as to form a toner image. Next, the toner image formed on the photosensitive body 30 is moved to a primary transfer position contacting the intermediate transfer belt 4, and is subsequently copied onto the intermediate transfer belt 4 at this primary transfer position. When the end of the image has been copied onto the intermediate transfer belt 4, the yellow image formation operation ends and the photosensitive body 30 and the intermediate transfer belt 4 stop at their initial positions.

During this image formation, the corona charger 32 charges the photosensitive body 30 at −450 V, so that an exposing potential of the photosensitive body 30 is −50 V. DC voltage of −250 V is applied to the developing roller 31. Furthermore, voltage of +1 kV is applied to the rollers 5 and 7 of the intermediate transfer belt 4.

When the photosensitive body 30 and the intermediate transfer belt 4 stop after the completion of the yellow image formation, the engagement of the driving source of the apparatus main body 1 with the yellow photosensitive body 30 is released, and then the carriage 2 rotates 90° in the arrow 29 direction shown in FIG. 1. Accordingly, at the same time that the yellow development unit 3Y moves away from the image forming position 47, the cyan development unit 3C is positioned to stop at the image forming position 47. When the cyan development unit 3C stops, the driving source of the apparatus main body 1 engages the cyan photosensitive body 30, and then the development unit 3C and the transfer belt unit begin operating, thus performing an image forming operation similar to the yellow image formation. Accordingly, the toner image of cyan is formed to overlap that of yellow on the intermediate transfer belt 4.

The above operation is repeated in order for magenta and black, so that a four-colored toner image is formed on the intermediate transfer belt 4.

When the top of the image arrives at the position of the secondary transfer roller 42 after the black toner image is transferred onto the intermediate transfer belt 4, the secondary transfer roller 42 is brought into contact with the intermediate transfer belt 4, so as to hold the recording paper sheet 18 sent from the paper feed unit 17 and convey it between the secondary transfer roller 42 and the intermediate transfer belt 4, thereby transferring the four-colored toner image as a whole onto the recording paper sheet 18. At this time, voltage of +800 V is applied to the secondary transfer roller 42. The recording paper sheet 18 onto which the toner image has been transferred passes between the fixing roller 43 and the pressure roller 44 so as to fix the image, and then is ejected by the paper ejection rollers 45A and 45B.

The toner that remains on the intermediate transfer belt 4 after the secondary transfer is wiped off by the cleaning roller 8 that contacts the intermediate transfer belt 4. The wiped toner is collected into the waste toner container (not shown in this figure).

After finishing the secondary transfer, the intermediate transfer belt 4 and the photosensitive body 30 stop again, and the carriage 2 rotates 90°. Then, the yellow development unit 3Y arrives at the image forming position 47 again, so as to prepare for the next color image forming operation.

Figure 11:
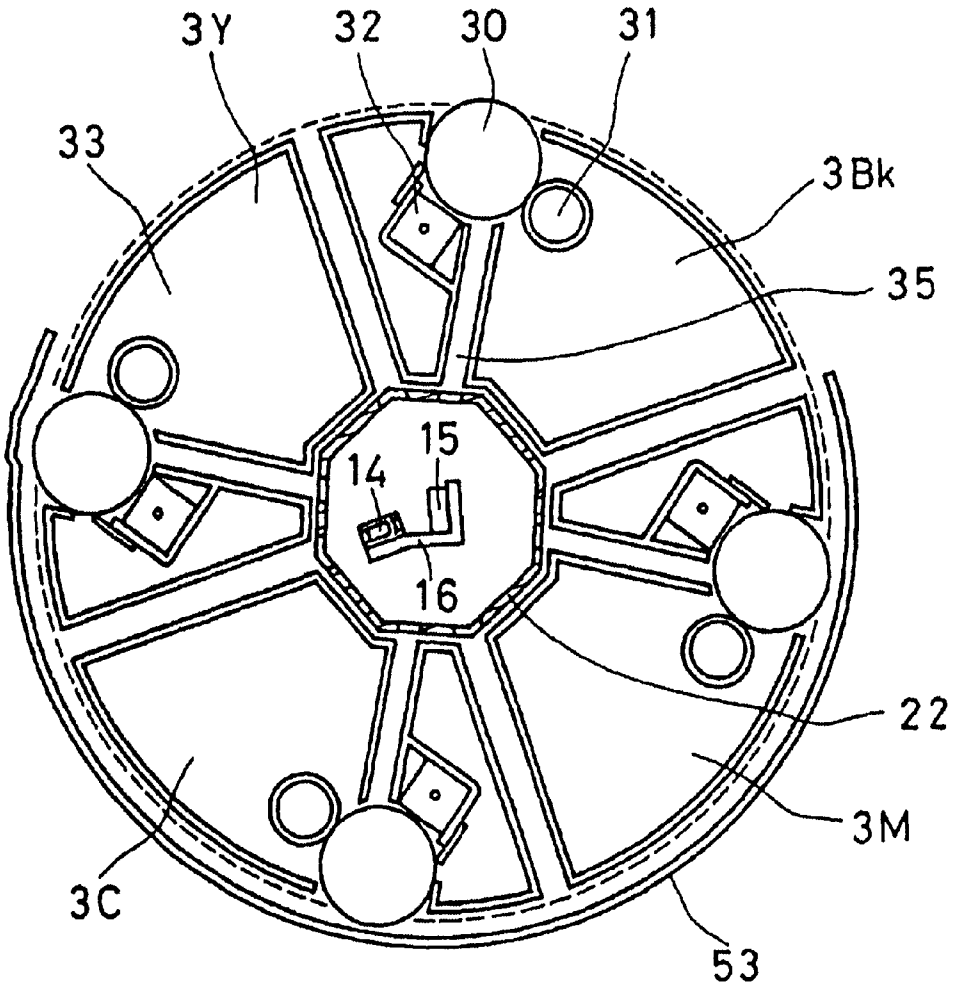
FIG. 11 is a sectional view showing another example of a pipe member constituting the carriage of the color image forming apparatus in one embodiment of the present invention.
Figure 12:
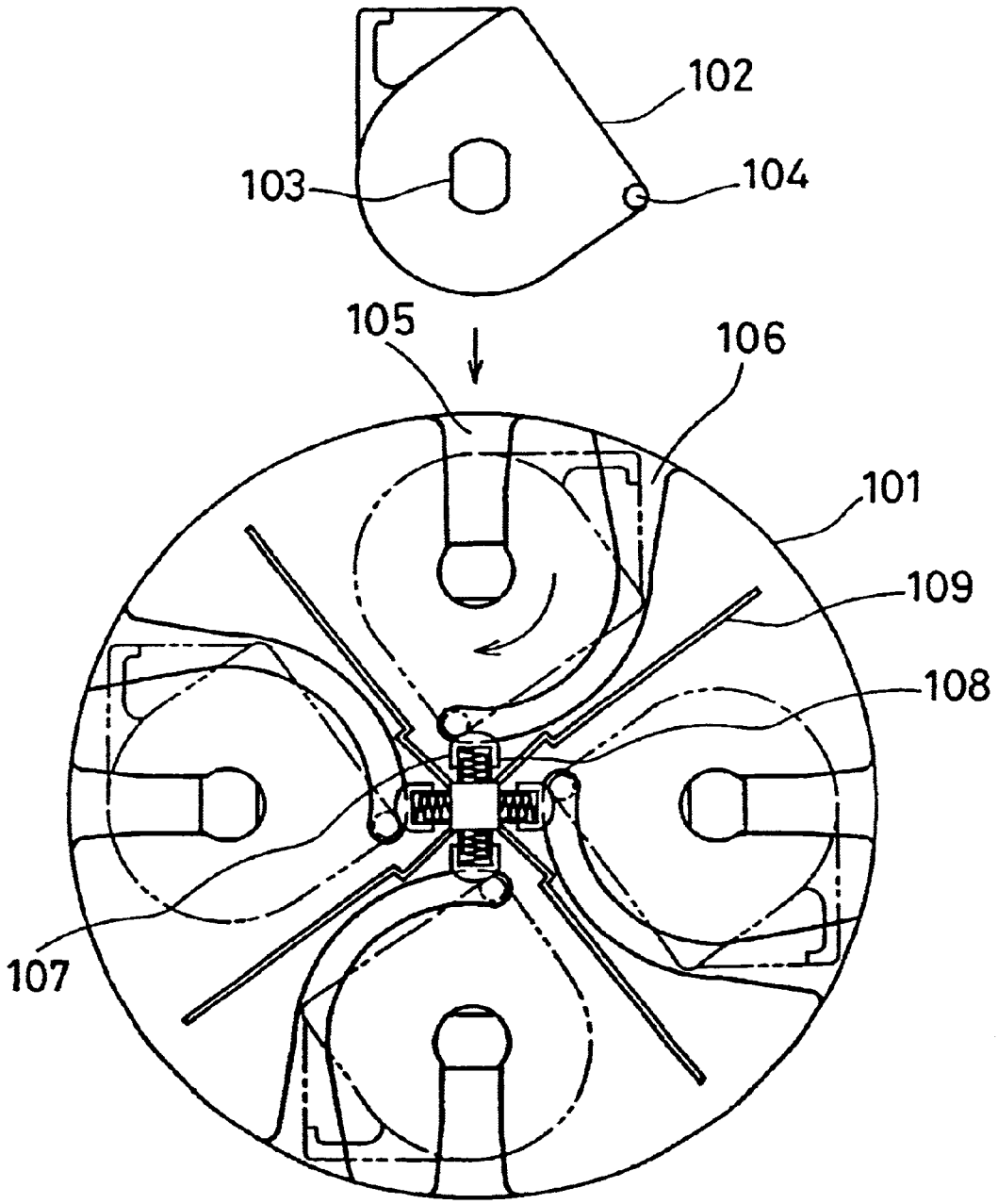
FIG. 12 PRIOR ART
FIG. 12 is a schematic view showing a configuration around a carriage of a conventional color image forming apparatus.

In the above embodiment, the hollow pipe member 22 having a square cross-section perpendicular to the rotation axis of the carriage 2 is used as a member for joining the left and right carriage side plates 21L and 21R. However, the cross-section of the pipe member 22 is not necessarily limited to square but may be other polygons. For example, as shown in FIG. 11, a pipe member 22 having an octagonal cross-section may be used.

Also, the above description is directed to an example of using a two-divided pressed component having a square or an octagonal cross-section as the pipe member 22 constituting the carriage, but the cross-section may be round. It also is possible to use a two-divided resin product instead of the pressed component.

Furthermore, in the above embodiment, the development unit with which the photosensitive body is formed integrally is used. However, the present invention can be applied to a color image forming apparatus in which the photosensitive body and the development unit are independent of each other so that only the development unit rotates while the photosensitive body is being fixed.

Moreover, as a system for positioning the carriage with respect to the apparatus main body, the carriage positioning pin that reciprocates in the direction parallel to the rotation axis of the carriage has been used. However, it also is possible to adopt a positioning method of providing a concave portion on the periphery of the carriage and using a pivotable lever or the like fitting this concave portion from a direction perpendicular to the rotation axis of the carriage (a radial direction).

Although the above description is directed to an example of providing the rib-like convex portion for carriage position detection on the carriage side plate as a carriage position detecting portion for detecting the carriage position, a concave portion, instead of the convex portion, can be used for detecting the carriage position. Similarly, although the above description is directed to an example of providing the convex portion for unit detection on the right end face of the development unit as a unit detecting portion, a concave portion, instead of the convex portion, can be used for detecting the development unit.

Also, the above description is directed to an example of providing the carriage position detecting portions in the same number as the development units. However, only one carriage position detecting portion may be provided so that a stopping position corresponding to the development unit for each color can be controlled by managing a rotation angle of the carriage from one carriage origin. For example, it may be possible to drive the carriage by a stepping motor and control the stopping position of the development unit for each color by the number of the driving steps from one origin.

In addition, although the flexible material with a resistance value of 1 kΩ to 10 MΩ has been used as the charge eliminating member for eliminating a residual electric charge in the development unit, it also is possible to eliminate the charge by electrically grounding a charge eliminating brush made of a sheet metal spring or a metal fiber to the apparatus main body via a resistor.

The invention may be embodied in other specific forms without departing from the spirit or essential characteristics thereof. The embodiments disclosed in this application are to be considered in all respects as illustrative and not restrictive, the scope of the invention being indicated by the appended claims rather than by the foregoing description, all changes that come within the meaning and range of equivalency of the claims are intended to be embraced therein.

What is claimed is:

1. A color image forming apparatus, comprising:

a plurality of development units, each development unit having a toner for a different color and a developing member;

a carriage for supporting the plurality of development units so as to be attachable/removable with respect to an apparatus main body;

a carriage driving system for rotating the carriage so as to move the plurality of development units sequentially and switch them between an image forming position and a waiting position;

a unit positioning system for positioning the development unit at a normal position with respect to the apparatus main body in the image forming position;

guide rails for restricting a moving track of the development unit during a rotation of the carriage; and a transfer system for transferring a toner image formed by the plurality of development units onto a printing medium.

2. The color image forming apparatus according to claim 1, wherein the guide rails are fixed to left and right side plates of the apparatus main body, and both ends of the development unit are supported by the guide rails.

3. The color image forming apparatus according to claim 1, wherein the guide rails are formed to have an arc shape whose center corresponds to a rotation center of the carriage, and a bisectional point of the arc shape of each of the guide rails is located lower than the rotation center of the carriage.

4. The color image forming apparatus according to claim 1, wherein at least one of the plurality of development units can be attached to/removed from the apparatus main body when located outside a fan-shape formed by the guide rails and a rotation center of the carriage.

5. The color image forming apparatus according to claim 1, wherein the development unit does not contact the guide rails when the development unit is positioned in the image forming position by the unit positioning system.

6. The color image forming apparatus according to claim 1, wherein each of the plurality of development units integrally comprises a photosensitive body having a surface on which a static latent image is formed, and development unit guide portions that slide in contact with the guide rails during the rotation of the carriage are provided on left and right ends of the photosensitive body.

7. The color image forming apparatus according to claim 6, wherein the development unit guide portions are provided on a line connecting a rotation center of the carriage and a center of the photosensitive body.

8. The color image forming apparatus according to claim 6, wherein a concave portion is provided in a part of the guide rails so that the development unit guide portions do not contact the guide rails when the development unit is positioned in the image forming position by the unit positioning system.

9. A color image forming apparatus comprising:

a plurality of development units, each development unit having a toner for a different color and a developing member;

a carriage for supporting the plurality of development units so as to be attachable/removable with respect to an apparatus main body;

a carriage driving system for rotating the carriage so as to move the plurality of development units sequentially and switch them between an image forming position and a waiting position;

a unit positioning system for positioning the development unit at a normal position with respect to the apparatus main body in the image forming position;

a carriage positioning system for positioning the carriage at a normal position with respect to the apparatus main body; and a transfer system for transferring a toner image formed by the plurality of development units onto a printing medium;

wherein the unit positioning system and the carriage positioning system both comprise a pin reciprocating in a direction parallel to a rotation axis of the carriage.

10. The color image forming apparatus according to claim 9, wherein, when the development unit and the carriage are positioned in the image forming position, a development unit other than the positioned development unit can be attached to/removed from the apparatus main body.

11. The color image forming apparatus according to claim 10, wherein, in a waiting state of the apparatus, the carriage is positioned and fixed to the normal position with respect to the apparatus main body.

12. A color image forming apparatus comprising:

a plurality of development units, each development unit having a toner for a different color and a developing member;

a carriage for supporting the plurality of development units so as to be attachable/removable with respect to an apparatus main body;

a carriage driving system for rotating the carriage so as to move the plurality of development units sequentially and switch them between an image forming position and a waiting position;

a transfer system for transferring a toner image formed by the plurality of development units onto a printing medium;

a carriage position detecting portion formed integrally with the carriage in an outermost peripheral portion of one of left and right ends of the carriage;

a position detection sensor for detecting the carriage position detecting portion; and a unit detecting portion formed integrally with the development unit so as to be located at substantially the same distance from a rotation center of the carriage as the carriage position detecting portion.

13. The color image forming apparatus according to claim 12, wherein a number of the carriage position detecting portions is the same as that of the development units supported by the carriage, and one of the carriage position detecting portions has a different shape from the other carriage position detecting portions.

14. The color image forming apparatus according to claim 12, wherein the unit detecting portion has a different shape from the carriage position detecting portion.

15. The color image forming apparatus according to claim 12, wherein a plurality of the unit detecting portions can be provided for each one of the development units.

16. A color image forming apparatus comprising:

a plurality of development units, each development unit having a toner for a different color and a developing member;

a carriage for supporting the plurality of development units so as to be attachable/removable with respect to an apparatus main body;

a carriage driving system for rotating the carriage so as to move the plurality of development units sequentially and switch them between an image forming position and a waiting position; and a transfer system for transferring a toner image formed by the plurality of development units onto a printing medium;

wherein the carriage comprises left and right carriage side plates that can position the development unit substantially and a hollow pipe member that joins the left and right carriage side plates, and the pipe member comprises two-divided sheet-like pipe element members.

17. The color image forming apparatus according to claim 16, wherein one of the two-divided pipe element members has at least one convex portion provided perpendicularly to a rotation axis of the carriage, and the other has a concave portion that fits the convex portion.

18. The color image forming apparatus according to claim 16, wherein the pipe member has a polygonal cross-section perpendicular to a rotation axis of the carriage.

19. A color image forming apparatus comprising:

a plurality of development units, each development unit having a toner for a different color and a developing member;

a carriage for supporting the plurality of development units so as to be attachable/removable with respect to an apparatus main body;

a carriage driving system for rotating the carriage so as to move the plurality of development units sequentially and switch them between an image forming position and a waiting position;

a transfer system for transferring a toner image formed by the plurality of development units onto a printing medium;

a unit feeder terminal that is provided on an end face of the development unit perpendicular to a rotation axis of the carriage, for supplying a voltage or an electric current necessary for an image formation to the development unit; and a main body feeder terminal that is provided in the apparatus main body, for supplying electricity by contacting the unit feeder terminal directly when the development unit is in the image forming position;

wherein the development unit is supported inside the carriage so as to be capable of reciprocating in a direction parallel to the rotation axis of the carriage.

20. The color image forming apparatus according to claim 19, further comprising a unit positioning system for positioning the development unit at a normal position with respect to the apparatus main body in the image forming position, the unit positioning system comprising a pair of unit positioning pins that are capable of moving in the direction parallel to the rotation axis of the carriage and restrict a position of the development unit in this direction, wherein the position of the development unit is restricted substantially using the unit positioning pin on a side of the main body feeder terminal, and then the position of the development unit is restricted using the unit positioning pin on the other side.

21. A color image forming apparatus comprising:

a plurality of development units, each development unit having a toner for a different color, a developing member and a unit feeder terminal for supplying a voltage or an electric current necessary for an image formation;

a carriage for supporting the plurality of development units so as to be attachable/removable with respect to an apparatus main body;

a carriage driving system for rotating the carriage so as to move the plurality of development units sequentially and switch them between an image forming position and a waiting position; and a transfer system for transferring a toner image formed by the plurality of development units onto a printing medium;

wherein the apparatus comprises a charge eliminating member for eliminating a residual electric charge in the development unit by contacting the unit feeder terminal directly when the development unit is located out of the image forming position.

22. The color image forming apparatus according to claim 21, wherein the charge eliminating member is made of a flexible material with a resistance value of 1 kΩ to 10 MΩ and fixed to the apparatus main body so as to be grounded.

* * * * *